US007641591B2

(12) United States Patent
Takizawa et al.

(10) Patent No.: US 7,641,591 B2
(45) **Date of Patent: *Jan. 5, 2010**

(54) LOWER LIMB FUNCTION TRAINING DEVICE

(76) Inventors: Shigeo Takizawa, 7-5-4 Zengyo, Fujisawa (JP) 251-0871; Kyoko Takizawa, 7-5-4 Zengyo, Fujisawa (JP) 251-0871

( * ) Notice: Subject to any disclaimer, the term of this patent is extended or adjusted under 35 U.S.C. 154(b) by 0 days.

This patent is subject to a terminal disclaimer.

(21) Appl. No.: 11/949,089

(22) Filed: Dec. 3, 2007

(65) Prior Publication Data

US 2008/0125294 A1 May 29, 2008

Related U.S. Application Data

(60) Continuation of application No. 10/779,126, filed on Feb. 12, 2004, now Pat. No. 7,322,904, which is a division of application No. 09/581,463, filed on Jun. 11, 2001, now Pat. No. 6,780,142.

(51) Int. Cl.
*A63B 71/00* (2006.01)
*A63B 22/00* (2006.01)

(52) U.S. Cl. ..... 482/8; 482/70

(58) Field of Classification Search ..... 482/79–80, 482/146–147, 1–8, 70–71, 51–53; 434/253; 601/27–29, 32, 35

See application file for complete search history.

(56) References Cited

U.S. PATENT DOCUMENTS 2,720,396 A * 10/1955 Pfaus ..... 482/130
3,672,670 A * 6/1972 Burzenski ..... 482/80
5,049,079 A * 9/1991 Furtado et al. ..... 434/253
5,902,214 A * 5/1999 Makikawa et al. ..... 482/4
5,947,872 A * 9/1999 Ryan et al. ..... 482/51
6,102,832 A * 8/2000 Tani ..... 482/4
6,148,448 A * 11/2000 Urso ..... 4/254
6,162,150 A * 12/2000 Lee ..... 482/51
6,162,189 A * 12/2000 Girone et al. ..... 600/592
7,481,739 B2 * 1/2009 Takizawa et al. ..... 482/8

OTHER PUBLICATIONS

Jill Whitall, PhD., et al.; Repetitive Bilateral Arm Training With Rhythmic Auditory Cueing Improve Motor Function in Chronic Hemiparetic Stroke. Stroke 2000;31:2390, 2000 American Heart-Association Inc.

Imitola Jaime, et al.; Directed migration of neural stem cells to sites of CNS injury by the stromal cell-derived 1-alpha/CXC chemokine receptor 4 pathway. Proc Natl Acad Sci U S A .2004 ; 101:18117-22, Epub Dec. 17, 2004 (abstract).

Shigeo Takizawa, An Application of the Civil Technology to the Sustainable Aged Society, Biophilia Rehabilitation Journal (2), pp. 1-24, Jun. 3, 2004.

Kunihiko Fukui, MD. PhD., et al, Proposition for the innovation of the rehabilitation medicine -Retrospection and reflection related to mechanism of Proprioceptive Neuromuscular Facilitation-, Biophilia Rehabilitation Journal, (3) pp. 17-25, 2005.

* cited by examiner

*Primary Examiner*—Fenn C Mathew

(57) ABSTRACT

A lower limb function training device which the patient themselves can use safely with no sense of fear, which is used to prevent or improve a drop foot contracture or to expand the excursion of a joint while preventing the patient from using it over an appropriate amount of exercise to the utmost, which allows the patient to select the type of exercise, and which enables measurement of state of the body. The device is provided with a foot rest support structure, a foot rest drive mechanism and a round-trip movement sensing device, and a brake device for braking the round-trip movement of the foot rest when the count reaches a preset value. The device is provided with a foot rest support structure, a foot rest drive mechanism and at least one contact sensor on a surface of the foot rest, and a brake device for braking the back-and-forth movement of the foot rest when the at least one contact sensor detects the soles of the feet contacting.

26 Claims, 22 Drawing Sheets

LOWER LIMB FUNCTION TRAINING DEVICE

This application is a continuation of application Ser. No. 10/779,126, filed Feb. 12, 2004, now U.S. Pat. No. 7,322,904, which is a divisional of application Ser. No. 09/581,463 filed on Jun. 11, 2001, now U.S. Pat. No. 6,780,142.

TECHNICAL FIELD

This invention is related to a lower limb function training device which makes the patient feel safe to use and is intended to prevent and/or improve the contracture of equines and also to expand the joints' range of motion.

BACKGROUND TECHNOLOGY

In the case of disorders where someone has a disability as a result of hemiparesis after apoplexy, a decline of muscular strength of the lower extremities is caused by the rupture of the Achilles' tendon and/or disabilities of the range of motion in the joint of a leg or knee originating in a bone fracture of the lower extremities and other conditions if left untreated, an ankle or knee becomes a contracture and chronic disabilities of the lower extremities have been originated.

Therefore, these functional disorders become the training or exercise for the needed recovery.

Also, there are the judgment standards, so-called due to the strength of muscular strength developed in 5 stages depending on the exercise corresponding to the muscular strength and is classified by the following expressions.

In other words;

1) the complete active exercise is performed by completely overcoming gravity with subjective muscular strength and resistivity from a strong external force,
2) the active exercise is available for a disabled person who has strong muscular strength and is capable of doing all of the exercises and is able to add a little resistivity with subjective intention,
3) the active assistive exercise is available for a disabled person to perform a subjective exercise while receiving assistance from his or her own healthy extremities and is capable of using their muscle strength within this degree,
4) the assistive exercise is available for a disabled person whose degree of muscular strength requires the assistance of a caregiver to exercise, and
5) the passive exercise is an exercise for disabled persons who do not have any muscular strength and are unable to control an exercise with their own subjective power to the degree of depending on contraction of a muscle without response.

It is classified to 5 aforementioned stages.

Furthermore, I divide;

a) the motivative exercise is available for a disabled person to perform a subjective exercise for a functional disturbance of an extremity while receiving assistance from both his or her own healthy side and devices. (In other words, in the case of one of the lower extremities is healthy and the other has a disturbance), b) the assistive passive exercise, which is basically a passive exercise by a physical therapist is necessary, performs exercise by movements of devices to give a passive exercise and c) the resistive exercise adds a load at the time of an exercise in the case of disabled person with subjective intention while receiving assistance from his or her own healthy extremities to do exercises for a functional disturbance of an extremity with assistance of devices, in this specification.

This exercise concept, which was named "JIKOTADOUUNDOU" by the research of this application inventor and the others, is proposing to the existing rehabilitation medicine and is decided the "MOTIVATIVE" exercise as an English notation and papers were presented at academies.

It is a tentative name from the Japanese word "JIKOTADOUUNDOU".

For example, exercise and/or training corresponding to the muscular strength of a disabled person become necessary in order to rehabilitate a decline in the function of the lower extremities and disabilities of the range of motion in the joints of legs or knees.

Hereon, for example in the intension of the lower extremities' muscle the plantar flexion exercise causes the foot tip to be inflected to the reverse side from the ankle shrinking the quadriceps, extending the anterior tibial muscle and shrinking the gastrocnemial muscle and Achilles' tendon and dorsiflexion exercise causes the foot tip to be inflected upwards towards the ankle extending the quadriceps, shrinking the anterior tibial muscle and extending the gastrocnemial muscle and the Achilles' tendon.

In the case that there is no ability to exercise oneself, the dorsiflexion and plantar flexion exercise mentioned were performed as a stretch exercise by the movement of the other persons power as a passive exercises by a physical therapist or another person.

There was the Dorsi-Plantar Flexion exercise device of the model utility right No. 2,004,587 for the plantar flexion and dorsiflexion exercise of the ankle and knee in order to rehabilitate a disabled person who is able to maintain the sitting position with subjective muscular strength for doing those exercises.

There was the Dorsi-Plantar Flexion exercise device of the design Pat. No. 997,739 for the plantar flexion and dorsiflexion exercise of the ankle and knee in order to rehabilitate a disabled person who is able to maintain the sitting position with subjective muscular strength for doing those exercises.

The Dorsi-Plantar Flexion training devices can perform the motivative exercise any time at one's convenience.

Also as another example, there is a walker for the structure of medical treatment that caused several proper casters to roll freely to the face fixed under the support guide part and that support guide part which is erect with the front and both right and left sides enclosed in order to assist a disabled person who has recovered to the degree that they are able to perform assistive walking.

And disabled persons who are able to perform exercise and gait training by supporting their upper body half and leaning over on the supporting guide part and pushing it to make the casters move freely, this action can be performed by oneself or when the assistance of a caregiver is needed.

However, it is difficult to perform passive exercises at one's convenience due to human problems.

The walker for medical use, which is used even when leaning over to the support guide part is not suited to be used as training for a person who is not permitted to keep weight on the leg after an operation of a bone fracture because the weight load is linked to the disabled foot during the early period after the operation, however it is permitted to be used by a person who has a disability of the lower extremities muscular strength and nerve that has recovered to some degree.

By the way, the Dorsi-Plantar Flexion exercise device of the model utility right No. 2,004,587 has adapted means to move several proper casters and rotate freely under a foot rest that keeps both feet on it and also has adapted securing tools to keep the feet on the upper surface of the foot rest and to allow the feet to detach freely.

Also, a lower extremities function training device of design Pat. No. 997,739 has adapted the means that has a spring under a foot rest and it is possible for both feet to be kept on and to detach freely on the upper surface of the foot rest.

However, in the case of a disabled person who prepares the above patents for the home training plantar flexion and dorsiflexion exercises with their own personal intention, the Dorsi-Plantar Flexion training device and the lower limb function training device exerted the opposite effect sometimes due to exercising as much as he or she can do while expecting early recovery.

Also in the cases that a director or caregiver are not close by, the disabled person who does not keep the caregivers instruction of the exercise repetitions and exceeds the equivalent range of the suited exercise by many times will not achieve the expected improvement.

Although, muscular-strength reinforcement became the purpose of training to the disabled person with whom the improvement progressed, a load is not applied at the time of exercises and it was not able to be used for muscular-strength reinforcement.

In the same time the heavily disabled person could not move the Dorsi-Plantar Flexion exercise device of the model utility right No. 2,004,587, a device of motionlessness condition, by a subjective movement of lower extremities of his or her own healthy side.

The Dorsi-Plantar Flexion exercise device of the model utility right No. 2,004,587 was not used widely.

Furthermore, a physical therapist measured the angle of extremities with contracture and measured the patient's body situation in order to know the condition of the patient.

A physical therapist and a patient were needed in the same place for this measuring.

This invention is used to solve the subjects mentioned above and to aim at offering a lower limb function training device, which can prevent exceeding the proper momentum being used as much as possible.

And it is the secondary purpose to offer a lower limb function training device, which can perform two kinds of exercises.

And also, it aims to offer a lower limb function training device, which can indicate the condition of a patient.

DISCLOSURE OF THE INVENTION

A lower limb function training device of this invention assembles a foot rest (1), in which both the feet are kept on and of which a reciprocating movement in a cross direction is available, round-trip movement number detection devices (18, 27), which detect the number of times of reciprocating motion in a cross direction of the foot rest and brake devices (17,18) which brake the foot rest on reciprocating motion in a cross direction when the number of times of reciprocating motion in a cross direction, which the round-trip movement number detection devices detected, reaches a set value of times.

Also, the foot rest may be free of the reciprocating movement of the cross direction.

And there is a case where a lower limb function training device assembles load devices (19, 29), which weights a load to a reciprocating movement in the cross direction.

Also, a lower limb function training device may assemble a drive unit that makes a foot rest move in a reciprocating motion in a cross direction.

And then there is a case when a brake device brakes a foot rest of a reciprocating movement in the cross direction if the average value of the movement speed in the cross direction of the foot rest requires more time to perform.

Furthermore, there is a case that a lower limb function training device assembles movement speed detection devices (16,26) that detect around the mean value of the movement speed of direction or detect the movement speed in the cross direction of a foot rest and a brake device that brakes on a movement in a cross direction of a foot rest when a movement speed that a movement speed detection device detected around the mean value of the movement speed of direction or to become a maximum speed movement value inside a regular interval set smaller than a set value.

Moreover, there is a case that a lower limb function training device outputs detection data that is detected by a round-trip movement number sensing device and a movement speed detection device at least one in the outside.

A contact sensor that assembles a surface of a foot rest is prepared, and there is a case that a contact sensor is available to detect feet contacted to four points of a foot rest simultaneously.

And, there is a case that a foot rest, which both feet are kept on is available to perform alternatively, a reciprocating motion in the cross direction or to rock in the vertical direction in the direction of order.

Also, there is a case that a foot rest, which both feet are kept on is available to perform alternatively, a reciprocating motion in a cross direction or to rock in a vertical direction in a direction of order, since a foot rest is available to rock in a vertical direction and a pivot axis for the rocking is able to perform a reciprocating motion.

Furthermore, there is a case that a round-trip movement number sensing device that detects a number of reciprocating motions in a cross direction and a pivot movement number detection device that detects the number of rocking movements of a foot rest are prepared.

And there is a case that a movement speed detection device, which detects movement speed in a direction of a foot rest and a rocking speed detection device, which detects a rocking speed of a foot rest are prepared.

A foot rest, which both the feet are kept on is available to rock of the vertical direction, a contact sensor that assembles the surface of a foot rest and a foot joint data acquisition device that obtains data of a condition of the joints of the lower extremities that is set on a foot rest are prepared and there is a case that a foot joint data acquisition device obtains data of a condition of the joints of the lower extremities when the contact sensor detects the feet contacted to four points of a foot rest simultaneously.

Furthermore, there is a case that a foot rest, which both the feet are kept on is available to rock of the vertical direction, a pivot movement number detection device that detects the number of the rocking movement of a foot rest and the brake device that brakes on the rocking movement when the numbers of the rocking movement that the pivot movement number detection detected the number of the rocking movement to reach a set value are prepared.

And there is a case that a load device which applies a load to the rocking of a foot rest.

Moreover, there is a case that a drive device, which makes a foot rest rock in the vertical direction. Also, there is a case that a foot rest, which both the feet are kept on is available to rock in the vertical direction and the brake device that brakes on the rocking movement when the time is needed longer for a foot rest to rock in the vertical direction is composed.

There is a case that a foot rest, which both the feet are kept on is available to rock in a vertical direction, a rocking speed detection device, which detects the rocking speed of the foot rest and a brake device that brakes on the rocking movement of a foot rest when either the rocking speed detection device detects a speed in a vertical direction around the mean value of the rocking movement speed or becomes a maximum speed value of the movement inside a regular interval set smaller than a set value, are prepared.

Also, a foot rest, which both the feet are kept on is available to rock of the vertical direction and at least one of a pivot movement number detection device that detects the number of the rocking movement of a foot rest or a rocking speed detection device, which detects the rocking speed of a foot rest are prepared and there is a case that at least one of detected data that the round-trip movement number sensing device and/or the movement speed detection device detect is output in the outside.

A round-trip movement number sensing device detects the number of the round trip movement of the cross direction of a foot rest and when the number of the round trip movement that the round-trip movement number sensing device detected reaches a setting value a brake device brakes on the movement of the cross direction of a foot rest.

Therefore, it can be prevented that patients exercise more than a set value of the number of times of a reciprocating motion. Consequently, preventing the excessive exercise of a patient.

A patient can do an exercise freely by setting number of one's intention in the case the foot rest is a round trip movement free in direction.

An exercise that adds a load is available, in the case that the lower limb function training device is equipped with a load device that adds a load on the movement of a cross direction of a foot rest.

A compulsive exercise is available, in the case that a lower limb function training device is equipped with a drive unit that causes the movement that makes a foot rest a reciprocating motion toward a cross direction.

And a brake device brakes on a foot rest and can suspend an exercise in the case that a patient gets tired and the movement of a foot rest becomes slow; in the case of a brake device braking in a cross direction of a foot rest at the time of a reciprocating motion in a cross direction movement of a foot rest needs a longer time.

Consequently, excessive exercise of a patient can be prevented.

Data for research and management of the momentum of a patient can come to hand easily, in the case that a lower limb function training device is outputting one of detected data by a round-trip movement number sensing device and a movement speed detection device in the outside at least.

A contact sensor that assembles the surface of a foot rest is prepared, and an investigation of the angle of lower extremities with contracture in other words the grade of contracture is available in the case that the contact sensor is available to detect feet contacted four points of a foot rest simultaneously.

And multiple-exercises are available to do with one machine in a case that a foot rest, which both the feet are kept on is available to perform alternatively a reciprocating motion or to rock of the vertical direction of the direction of order.

And also multiple-exercises are able to be performed with one machine in a case that a foot rest is able to perform alternatively, a reciprocating motion in a cross direction and to rock in a vertical direction in a direction of order due to a foot rest, which both the feet are kept on is able to rock in a vertical direction and a pivot axis for rocking is available to perform a reciprocating motion.

Furthermore, to obtain various kinds of data is available easily in the case that the round-trip movement number sensing device, which detects the number of times of reciprocating motion and a pivot movement number detection device, which detects the number of the rocking movement of a foot rest are prepared.

And, to obtain various kinds of data is available easily in the case that the movement speed detection device, which detects the movement speed of the cross direction of a foot rest and a rocking speed detection device, which detects the rocking speed of a foot rest are prepared.

And a foot rest, which both the feet are kept on is available to rock of the vertical direction, a contact sensor that assembles for the surface of a foot rest and a foot joint data acquisition mean, which obtains the data of the condition of the joints of the lower extremities that is set on a foot rest are prepared and there is a case that the foot joint data acquisition mean obtains the data of the condition of the joints of the lower extremities when the contact sensor detects feet contacted four points of a foot rest simultaneously.

In such a case, investigation of an angle of lower extremities with contracture in other words a grade of contracture can be automated.

Furthermore, the excessive exercise of a patient can be prevented in the case that a foot rest, which both the feet are kept on is available to rock in a vertical direction, a pivot movement number detection device that detects the number of the rocking movements of a foot rest and the brake device that brakes on the rocking movements when the number of the rocking movements that the pivot movement number detection detected the number of the rocking movements reach a set value, are prepared.

Adding a load at pleasure is available for an exercise, in the case that a load device, which applies load to rocking of a foot rest, is equipped.

Moreover, a compulsive exercise is available, in the case that a drive unit, which makes a foot rest rock of the vertical direction is equipped.

Furthermore, the excessive exercise of a patient can be prevented in the case that a foot rest, which both the feet are kept on is able to rock in a vertical direction and a brake device, which brakes on the rocking movements in a vertical direction of a foot rest when a longer time is needed for a foot rest to rock in a vertical direction, are equipped.

Furthermore, the excessive exercise of a patient can be prevented in the case that a foot rest, which both the feet are kept on is able to rock in a vertical direction and a rocking speed detection device, which detects the rocking speed of the foot rest and a brake device, which brakes on the rocking movement of the foot rest when either the rocking speed detection device detects a speed in a vertical direction around the mean value of the rocking movement speed or becomes a maximum speed value of the movement inside a regular interval set smaller than a set value, are equipped.

And, there is a case that a foot rest, which both the feet are kept on is available to rock in a vertical direction, at least one of a pivot movement number detection device that detects the number of the rocking movements of the foot rest or a rocking speed detection device rocking, which detects the rocking speed of a foot rest are prepared and at least one of detected data that the round-trip movement number sensing device or the movement speed detection device detect may output in the outside.

In such a case, Data for research and management of the momentum of a patient can come to hand easily.

DESCRIPTION OF THE PREFERRED EMBODIMENTS OF THE INVENTION

Figure 1:
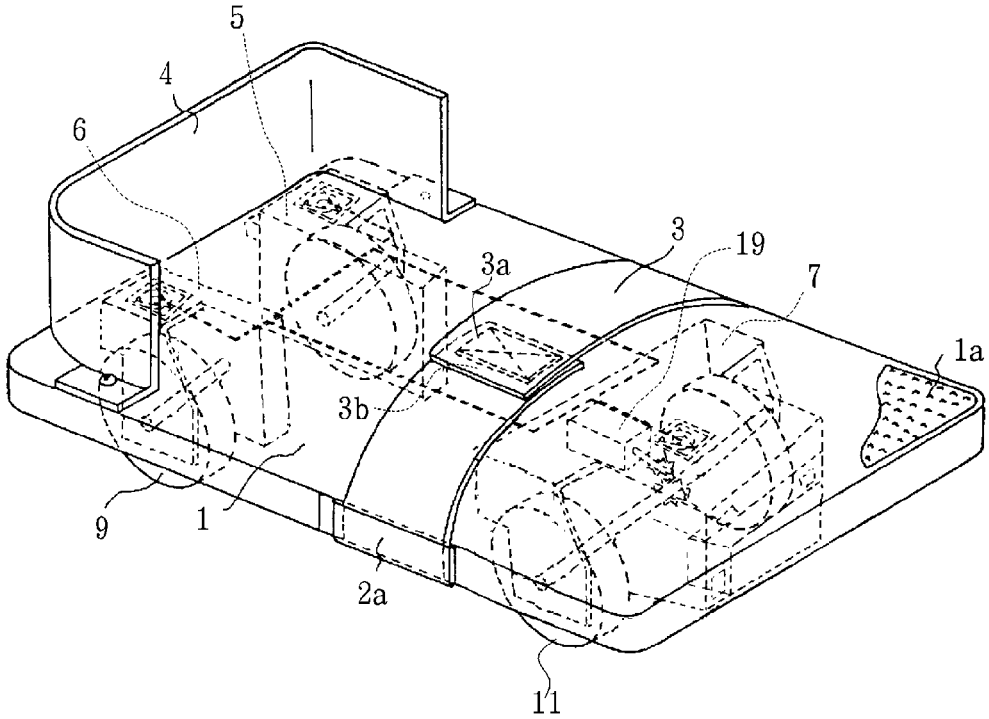
FIG. 1 is a perspective view of a lower limb function training device of the first embodiment.
Figure 8:
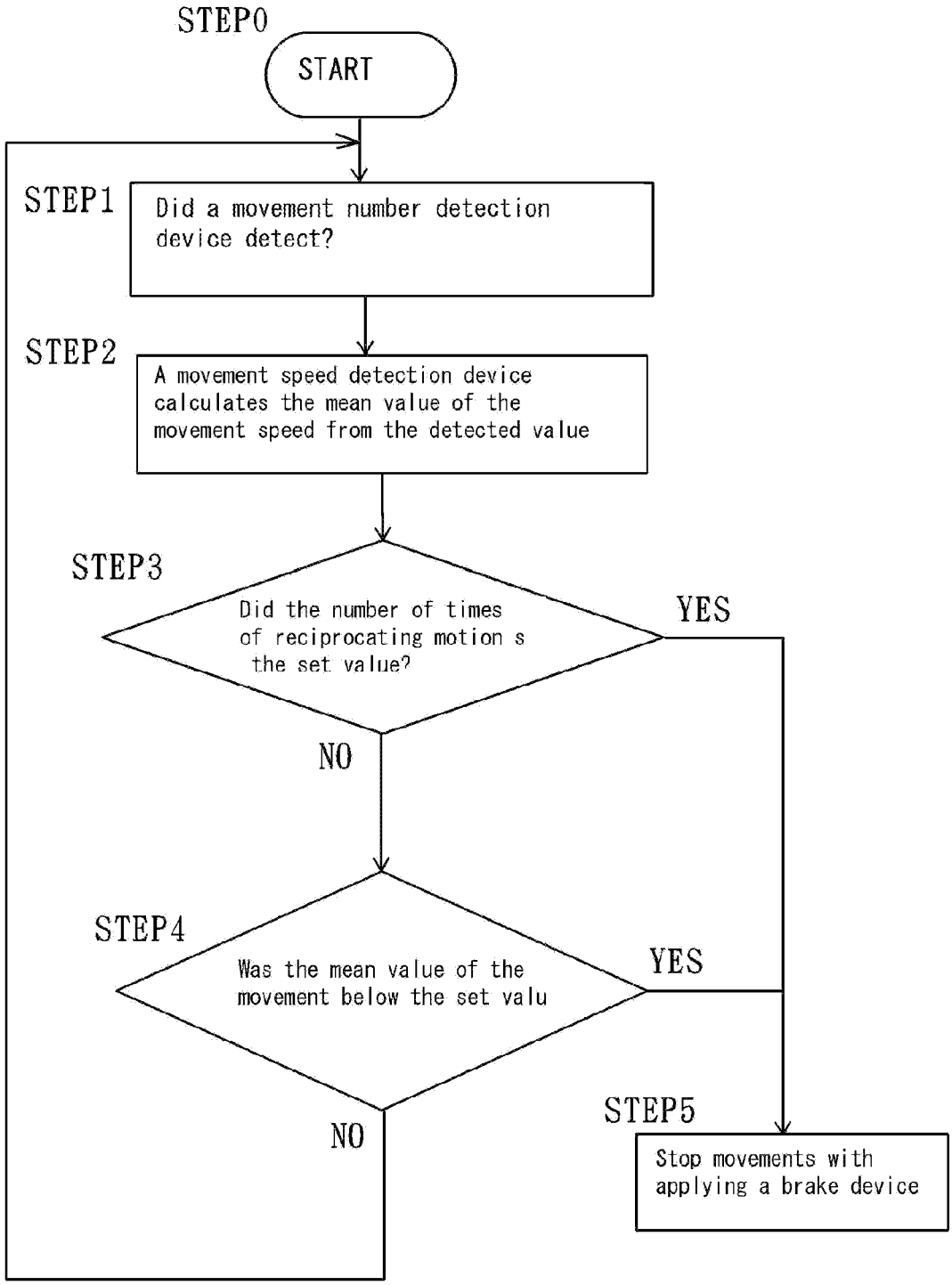
FIG. 8 is a flowchart in case, which the connection between a wheel and a motor are cut.

I explain the first embodiment of a lower limb function training device in this invention by using FIG. 1 and FIG. 8.

FIG. 1 is a perspective view of a lower limb function training device of the first embodiment.

Figure 2:
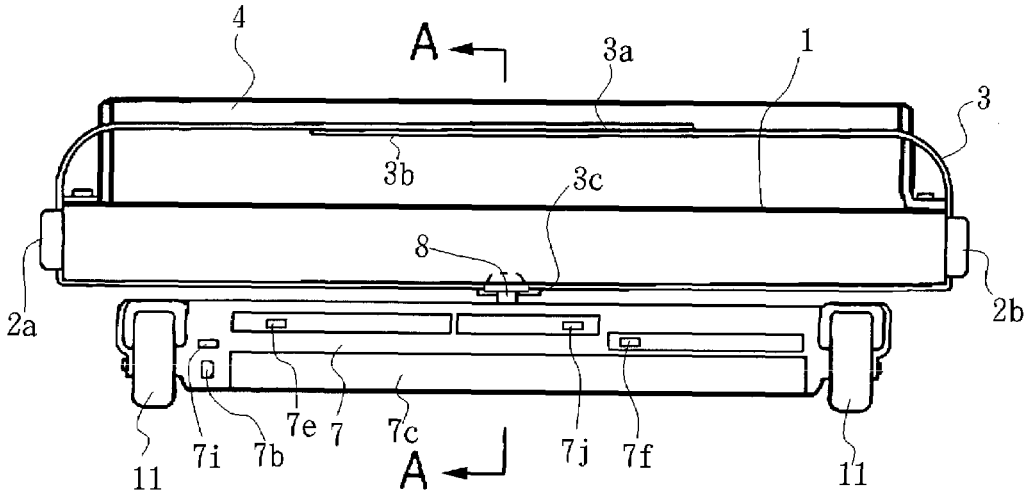
FIG. 2 is a front view of FIG. 1.

FIG. 2 is a front view of FIG. 1.

Figure 3:
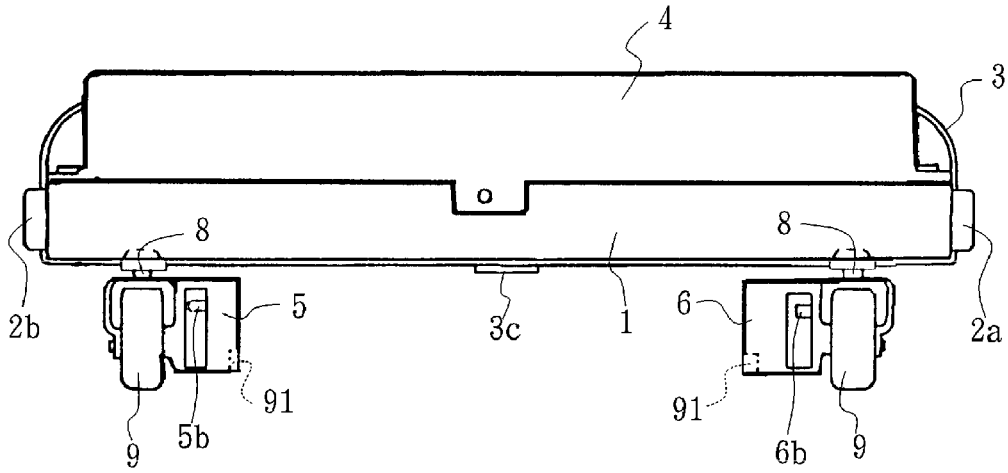
FIG. 3 is a rear view of FIG. 1.

FIG. 3 is a rear view of FIG. 1.

Figure 4:
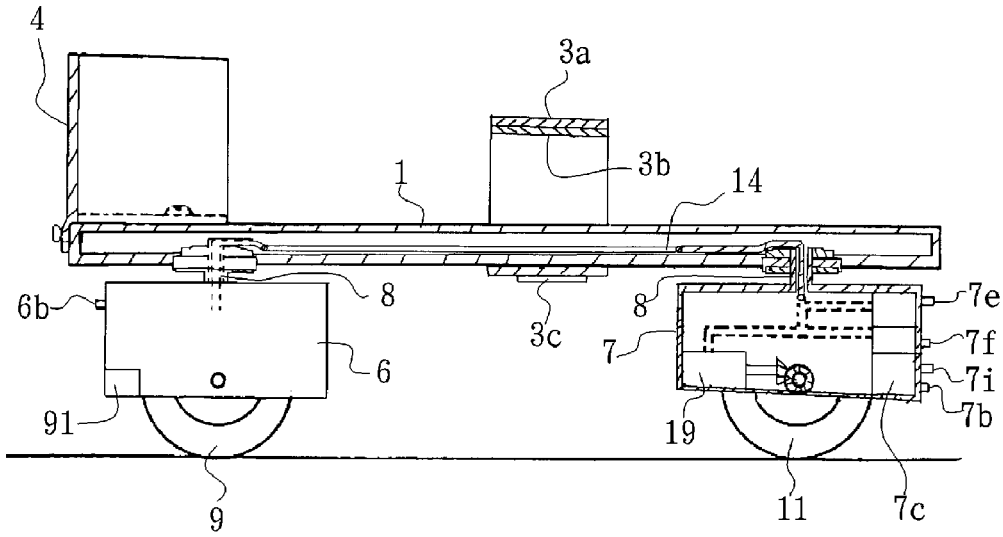
FIG. 4 is a A-A cross section view of FIG. 2.

FIG. 4 is a A-A cross section view of FIG. 2.

Figure 5:
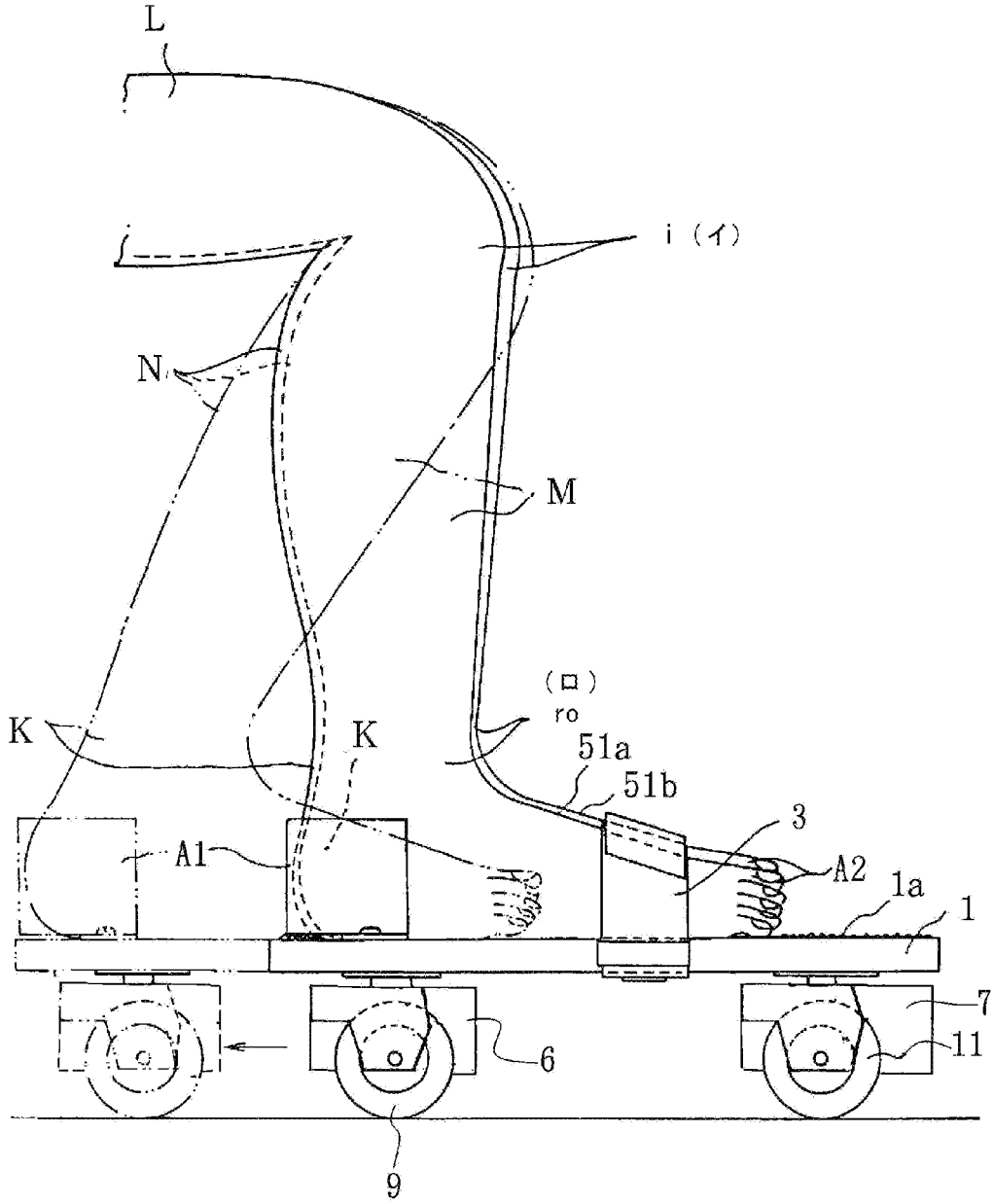
FIG. 5 is a side view while using, which sets and fixes the two legs.

FIG. 5 is a side view while using, which sets and fixes the two legs.

Figure 6:
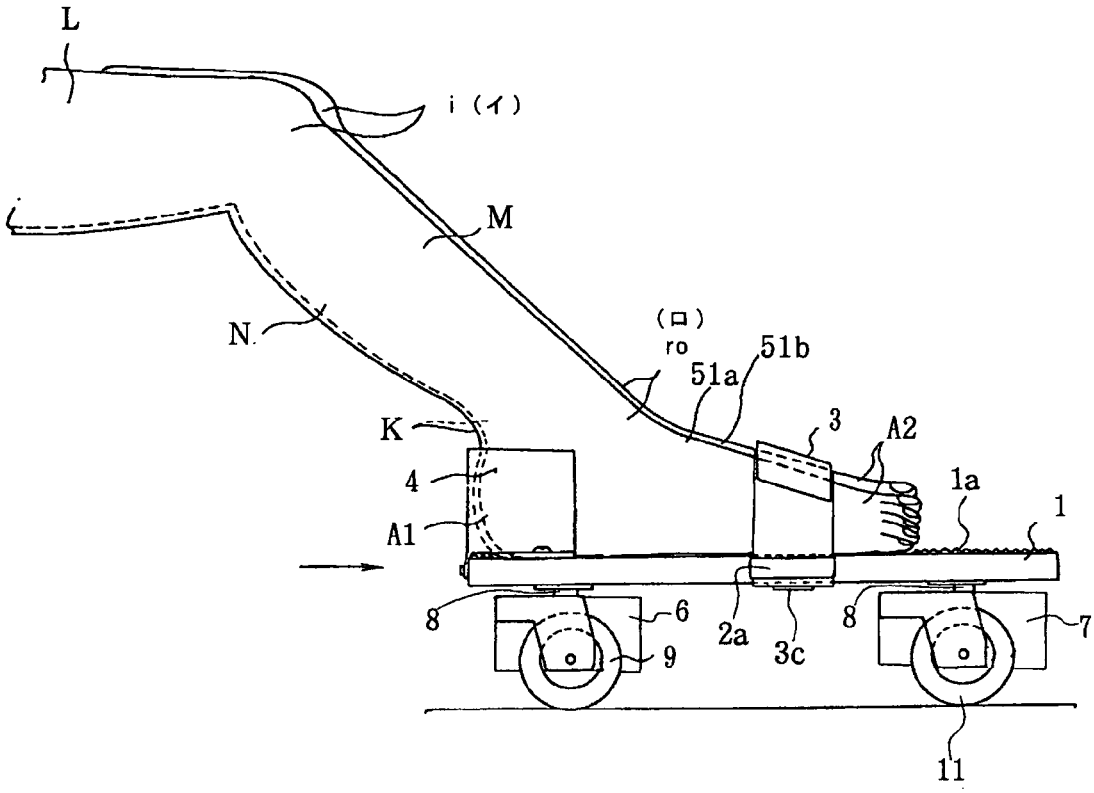
FIG. 6 is a side view showing the state of performing Plantar Flexion exercise.

FIG. 6 is a side view showing the state of performing Plantar Flexion exercise.

Figure 7:
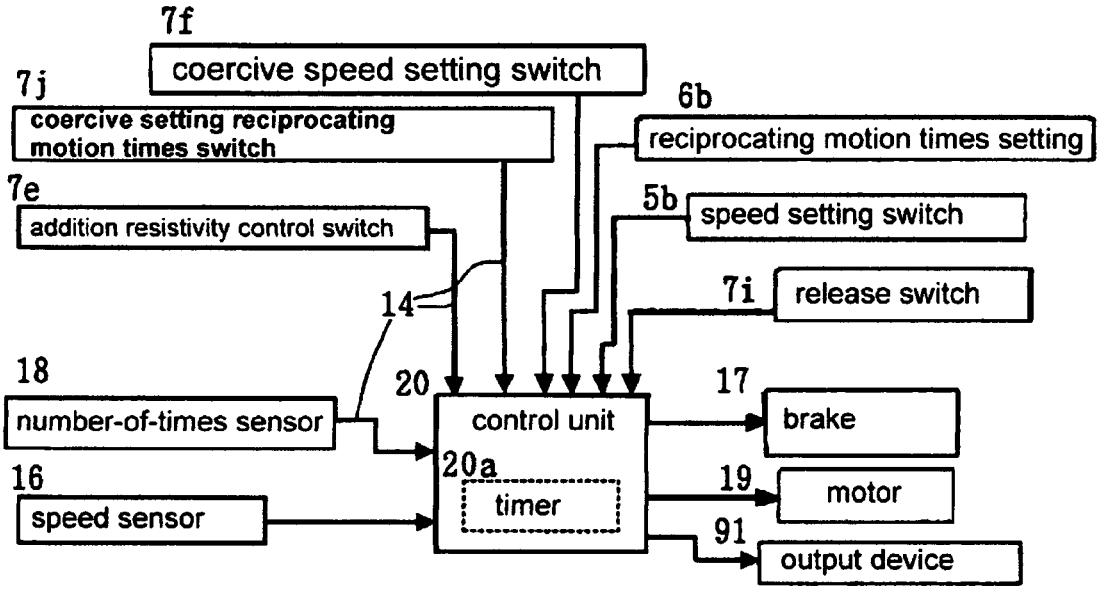
FIG. 7 is a control circuit diagram.

FIG. 7 is a control circuit diagram.

FIG. 8 is a flowchart in case, which the connection between a wheel and a motor are cut.

Furthermore, the drawing of a rear wheel support of a right and left part is omitted in FIG. 2.

Also, the drawing of the front wheel support parts is omitted in FIG. 3.

A foot rest (1) is formed with wood in midair with a plane abbreviation rectangular (when necessary another material can be used in place of wood, such as plastic).

The foot rest (1) is having an area of sufficient width that can put both feet (51*a*, 51*b*) (for example, the size of the side from approx 20 cm to approx 25 cm, length).

Therefore, a disabled person can set both feet (51*a*) and (51*b*); a foot (51*a*) with disability, which has hemiparesis of lower extremities of a nerve, decline of the lower limbs extremities muscular strength that originates from a plasmotomy of Achilles' tendon K of any of the lower extremities, a disability of a range of motion, etc. of an ankle (ro), and also a knee (i) of any bone fracture etc. and a foot (51*b*) of the other healthy foot without any disability in the condition of sitting on a chair.

A slip stopper (1*a*) assembles in the upper surface of a foot rest (1) if needed.

The slip stopper (1*a*) is formed by pasting up the rubber sheet, for example, when a foot rest (1) is formed by plastic etc., it can be formed in the upper surface of a foot rest (1) at one.

Although a foot rest (1) is a hollow structure, if an information transmission route (14) can be assembled that is composed of electric wire etc, within the hollow space.

A heel support part (4), which is formed by belt like straps, such as plastic, skin and cloth, for example, is almost shaped like a letter C shown in a plane view and then is fixed with tack wear, nail wear, screw, etc. impedes a movement to the rear of the heel of two feet (51*a*, 51*b*) if the two feet (51*a*, 51*b*) keep on the surface of a foot rest (1).

Furthermore, in the case that the heel support part (4) is formed from plastic, it may form a unit to a foot rest (1).

And also, a setting band (3) that the edge department of the right and left was adhered to a foot rest (1) is set up both with the interval from this heel support part (4) to the front and in the omission central position of the long hand direction of a foot rest (1).

A setting band (3) is adhered to under the surface of a foot rest (1) as for the center, both end parts which pass the plane Japanese letter (コ:ko)character form conducive brackets (2*a*, 2*b*) respectively that assemble in each right and left aspect of a foot rest (1) of each and are keeping upward of a foot rest (1).

And both right and left end parts (3*a*, 3*b*) of band setting band (3) are overlapped mutually and are engaged by a proper engaging means such as a velvet fastener, snapshot, hook, etc easily.

However, the setting band (3) is composed of one setting band, it is available to compose of two setting bands, the end parts of which are fixed in a foot rest (1).

The setting band (3), which covers insteps of both feet (51*a*, 51*b*) from upper side is impeding the movement of both feet (51*a*, 51*b*) from the upper and front side.

Securing tools (3,4) that hold both feet (51*a*, 51*b*) in a foot rest (1) are composed by the heel support part (4) and the setting band (3).

The structure, material, etc. of securing tools (3,4) are possible to change suitably if both feet (51*a*, 51*b*) can be kept and set on a foot rest (1).

Furthermore, at the condition that a patient recovered and strength of each foot can be applied to both legs, securing tools (3,4) to both legs may be unnecessary.

Rear wheel support parts (5, 6) that freely rotate horizontally around a center perpendicular axis (8) are attached to each side, right and left at the lower back part of the foot rest (1).

And a left side rear wheel (9) is attached and rolls freely on a wheel support part (5) on the left side and the speed sensor (16) as a movement speed detection device that detects the rolling speed of the rear wheel (9) and brake (17) as a brake device that brakes the rotation of the left side rear wheel (9) assembly.

A right side rear wheel (9) is attached and rolls freely on a wheel support part (6) on the right side and a number-of-times sensor (18), a round-trip movement number sensing device, that detects the number of round trip movements of the rear wheel (9) and brake (17) a brake device that brakes a rotation of the right side rear wheel (9) assembly.

Although, the rear wheels (9) move in a cross direction while rolling and are also capable of moving around while inclining right and/or left in a cross direction due to the rear wheel support parts (5,6) pivoting right and/or left.

The wheel support parts (5,6) are regulated in range (for example, approx 10 degrees right and left in both directions) and are not able to move in a side-to-side direction.

Also, a front wheel support part (7) is attached to the front lower part of the foot rest (1) and pivots freely around a center perpendicular axis (8).

The right and left front wheels (11) are attached to a front wheel support part (7) and roll freely with a motor (19) that drives the front wheels (11) and a brake (17) as a brake device that brakes a rotation of the front wheel (11) assembly.

Front wheels (11) move around a cross direction while inclining right and left due to the front wheel support part (7) pivoting right and left; same as the rear wheels (9).

The front wheel support part (7) is regulated in range (for example, approx 10 degrees right and left in both directions) and are not able to move in a side-to-side direction.

Thus, this explains the reason for pivoting of the front wheels (11) and rear wheels (9) that were regulated in the condition that a side-to-side motion is directed.

This lower limb function training device needs to restrict the movement of a side-to-side direction in order to detect an exercise of cross direction and to use the data.

However, the forward direction of an exercise tends to deflect, in the same direction, of a foot (51*a*) with a disability because of the power of another healthy foot (51*b*) without any disability is strong due to setting both a foot (51*a*) with a disability and another healthy foot (51*b*) without a disability.

In this case, it becomes a corrective exercise instead of a natural exercise by readjusting to move completely straight, and then the continuation of training and exercise might be difficult due to big loads applied to a foot (51*a*) with a disability.

Thereupon, this regulates the right and left pivoting movement angles of the front (11) and rear wheels (9) that can move crosswise in a line with an angle of about 10 degrees right and left from center, the middle empirically in order that the difficulty of continuation of such training and exercise are eliminated.

Furthermore, when the training leader admits necessity and a corrective exercise (the body parts that cause abnormality by becoming contracture is corrected by exercise) is necessary, it is possible to use a corrective exercise due to making wheels (11,9) impossible to pivot in the side-to-side direction and move only as a fixed wheel which moves only in the cross direction of order.

And, a control unit (20) that is composed of a microcomputer etc. attaches to a lower limb function training device and a speed sensor (16) and also a number-of-times sensor (18), are connected to the input end through an information transmission route (14), on the other hand, a brake (17), a motor (19) and an output device (91) are connected through an information transmission route (14) on the side output.

Furthermore, an output device (91) is not necessarily needed to assemble; detecting values of a speed sensor (16) and a number-of-times sensor (18) can be placed in the outside by this output device (91).

A speed sensor (16) detects turning speed of rear wheels (9) in other words the movement speed of a foot rest (1).

Although, a foot rest (1) reciprocates and the direction of movement is changed alternately, speed sensor (16) is outputting the absolute value of the movement speed of the foot rest (1).

A timer (20*a*) is built in the control unit (20), and the average value for every interval of detected speed (for instance, each specified time and the movement of a foot rest (1) during forward movement) by the speed sensor (16) can be computed.

Furthermore, the lowest value of the mean value of movement speed of a foot rest (1) can be set up by a speed setting switch (5*b*) to the control unit (20).

Also, the maximum value of the reciprocating movement of a foot rest (1) can be set up to control unit (20) by a reciprocating motions setting (6*b*).

According to condition of a patient, an increment of 5 cm from the speed of 5 cm a second to the speed of 30 cm a second and that an increment of 10 cm from the speed of 30 cm a second to the speed to of 50 cm a second can be set up by a speed setting switch (5*b*) to the control unit (20).

And, a control unit (20) actuates all brakes (17) breaking and suspending the rear wheels (9) and front wheels (11) in the case that the average speed that is calculated with control unit (20) fell below the speed that was set up by a speed setting switch (5*b*).

And, it is not possible to exercise once again, because the brakes (17) are not disarmed if a release switch (7*i*) is not operated.

Number-of-times sensor (18) that detects the number of the reciprocating movement of a rear wheel (9) in other words the number of the reciprocating movements of a foot rest (1) outputs the detected number to the control unit (20).

This control unit (20) actuates all the brakes (17) breaking and suspending the rear wheel (9) and front wheel (11) in the case that detecting value of number-of-times sensor (18) reaches a set value of reciprocating motion setting (6*b*) by comparing the number of the reciprocating movements from number-of-times sensor (18) to the value that is set.

And, it is not possible to do an exercise once again, because the brake (17) is not disarmed if a release switch (7*i*) is not operated.

An exercise number that should be accomplished for each increment of 10 times, a standard from 10 times minimum to 50 times maximum is set by the reciprocating motion setting (6*b*) to the control unit (20).

Furthermore, the arrangement and structure of the parts of a control unit that make it possible to induce a proper change can arrange speed sensor (16) and a number-of-times sensor (18) with mixed loading to the same unit A power switch (7*b*), a coercive speed setting switch (7*f*), a coercive setting reciprocating motion switch (7*j*), an addition resistivity control switch (7*e*) and a release switch (7*i*) for all of control releasing are assembled in a front wheel support part (7).

A lower limb function training device of the first embodiment has the function as an assistive passive exercise device due to assembling a battery storage part (7*c*) as a battery, a load device of a front wheel (11) and a motor (19) as a drive unit in a front wheel support part (7).

The speed in increments of 5 cm from the minimum speed of 5 cm a second to the maximum speed of 30 cm a second set up by a coercive speed setting switch (7*f*) and also a number of the reciprocating movements of a foot rest (1) for each standard increment of 10 times, from a minimum 10 times to a maximum 50 times is set up by a coercive reciprocating motion setting switch (7*j*) to the control unit (20).

Then, the control unit (20) drives the motor (19) and makes a foot rest (1) reciprocate at a set speed and makes a foot rest (1) suspend by motor (19) suspending at the number of reciprocating movements become a set value.

Thus, we can make patients exercise automatically.

Furthermore, a connection has cut the transmission system between motor (19) and front wheel (11) with a clutch. and the load of motor (19) is not transmitted in the case that motivative exercise is done.

Even the power source of the others such as the engine is good, although a drive unit is a motor (19).

Also a battery storage part (7*c*) serves to be used by the battery or other power supplies that are sufficient as a battery.

In the case that training is started from the condition without resistivity and the necessity to load for training is recognized due to the improvement of a patient function is seen, control unit (20) loads a resistivity that as a load etc. is born from the turn of motor (19) on the basis of this set value to the front wheel (11) due to the set up of increments 0.5 kg from 0.5 kg to 2.5 kg is available with an additional resistivity control switch (7*e*) to the control unit (20).

For example in the case that there are hemiparesis after apoplexy, a decline of muscular strength of the lower extremities is caused by the rupture of the Achilles' tendon (K) and/or disabilities in the range of motion of ankle (ro) originating in a bone fracture of the lower extremities, both feet (51*a*, 51*b*) are set and fixed in a foot rest (1) by setting together the Heels (A1) of both foot (51*a*) and foot (51*b*), foot (51*a*) with disability and another healthy foot (51*b*) without any disability to heel support part (4) and attaching foot tip (A2) by setting band (3) strapping both feet (51*a*, 51*b*), fitted in the sitting position because of the first embodiment of lower limb function training device is composed like this (Refer to full line and also dashed line of FIG. 5).

Thus, it is easily able to set and put on both feet (51*a*, 51*b*) with the upper surface of a foot rest (1) corresponding to the size of a disabled person's feet, because it is good that [the] heels (A1) are set and put on to a heel support part (4), a setting band (3) sets and attaches a foot tip (A2) in order to set and fix both feet (51*a*, 51*b*) with a foot rest (1).

Herewith, the training and also bending and stretching exercises of knee (i) and flexion and dorsiflexion of ankle (ro) are done from solid line and also dashed line of FIG. 2 due to making a foot rest (1) move in a cross direction horizontally with wheels (9,11) rotated by gradually adding power while controlling subjective movement and making lower extremities extend and contract and muscular strength of lower extremities reinforce and also expand a range of motion of ankle (ro) in order that foot (51*b*) without any disability assist foot (51*a*) with a disability by not increasing a burden.

In other words, in the case that a foot rest (1) that sets and fixes both feet (51*a*, 51*b*) move forward as drawing of FIG. 6 knee (i) opens from almost 90 degrees and extends, quadriceps (L) as lower extremities muscles shrink, the anterior tibial muscle (M) extends, both the gastrocnemial muscle (N) and Achilles' tendon (K) shrink and ankle (ro) flexes to plantar Flexion.

In the case that a foot rest (1) moves in a cross direction by expansion and contraction of both knee (i) and ankle (ro), so that the burden of both feet (51*a*, 51*b*) decreases due to no side vibration but stable transfer and both feet (51*a*, 51*b*) tightened with the setting band (3) and heel support part (4) as a means to hold are held on a foot rest (1) and also a slip stopper (1*a*) assembly on a foot rest (1), both feet (51*a*, 51*b*) do not slip on a foot rest (1) but move with a foot rest (1).

Although effect of the exercises mentioned are conducive to improve disabilities, the number of the exercise performed (step 3) will stop automatically (step 5) and it is conducive to improvement of disabilities due to the number of exercises detected with number-of-times sensor (18) (step 1 of FIG. 8) and also the number of exercises that should be performed is previously set up to 10 times as a minimum and 50 times as a maximum in order that the disabled persons who have a desire to recover early as possible and who do exercises exceeding the equivalent range, which exceed exercises best suited to them, will not get the expected improvement or is nonexistent.

Although there is a difference in the speed of movement for every person, usually speed decreases due to fatigue from a constant speed at the time of use.

Thereupon, it is conducive to improve disabilities, in the case that the detected movement speed of a foot rest (1) with speed sensor (16) (step 2) and the average speed are detected under setting speed (step 4) by setting up an increment of 5 cm in the minimum range 5 cm a second to the maximum speed of 30 cm a second to the control unit (20) previously, that it stops by the work of a brake system in accordance with judging fatigue.

The range of users spread more and more and a high effect is obtained because when necessity is admitted for training to adding resistivity for exercise and starting from the condition without resistivity and improvement has been seen in the function of a patient, adding resistivity in increments of 0.5 kg from 0.5 kg to 2.5 kg of load resistivity that are borne from the turn of motor (19) by an addition resistivity control switch (7*e*) to an axle (11) is available.

Furthermore utility of it rose remarkably by having the devices alternate functions as a passive exercise in the case that heavily disabled persons cannot move the device and motionlessness conditions of the lower extremities of the healthy side cannot perform the motivative exercise because it functions as an assistive passive exercise device and was given due to an exercise performed automatically at the speed of 5 cm increments from the speed of 30 cm a second to a speed of 5 cm a second with the minimum that was set up with a coercive speed set switch (7*f*) and a control unit that stops by itself within the designated number of times that is set up at increments of 10 from the minimum of 10 times, to the maximum of 50 times with a coercive reciprocating motion setting switch (7*j*) being set up.

Next, I explain the second embodiment by using FIG. 9 to FIG. 13.

Figure 9:
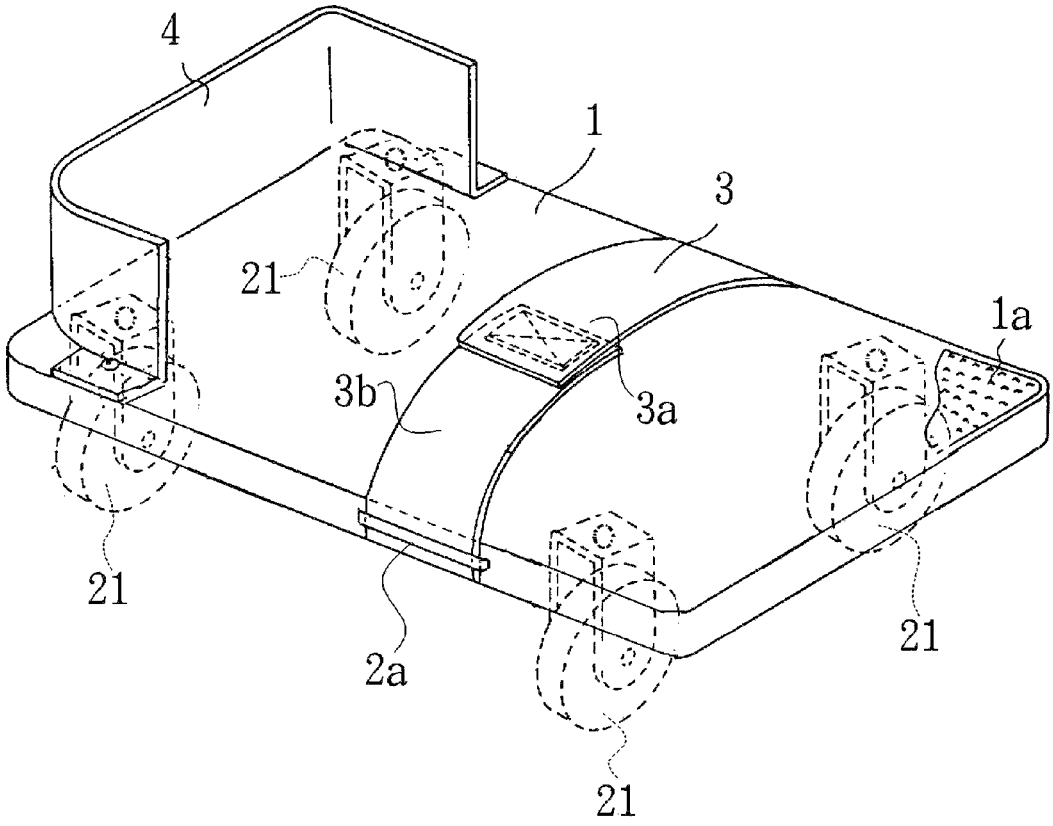
FIG. 9 is a perspective view of a foot rest of the 2nd embodiment.

FIG. 9 is a perspective view of a foot rest of the second embodiment.

Figure 10:
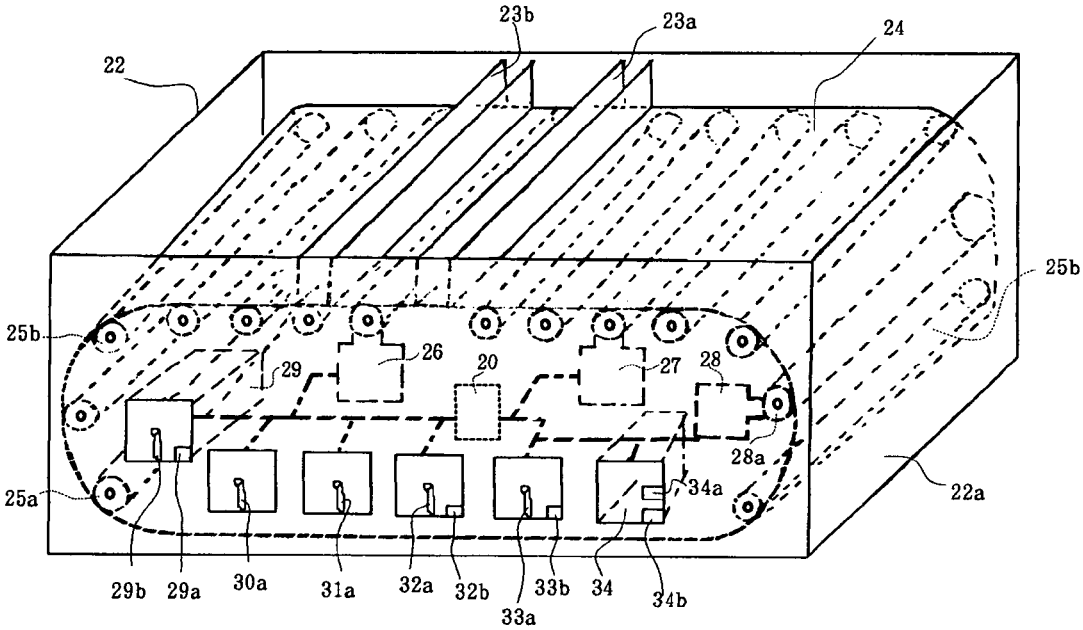
FIG. 10 is a perspective view of a foot rest Move Stand of the 2nd embodiment.

FIG. 10 is a perspective view of a foot rest move stand of the second embodiment.

Figure 11:
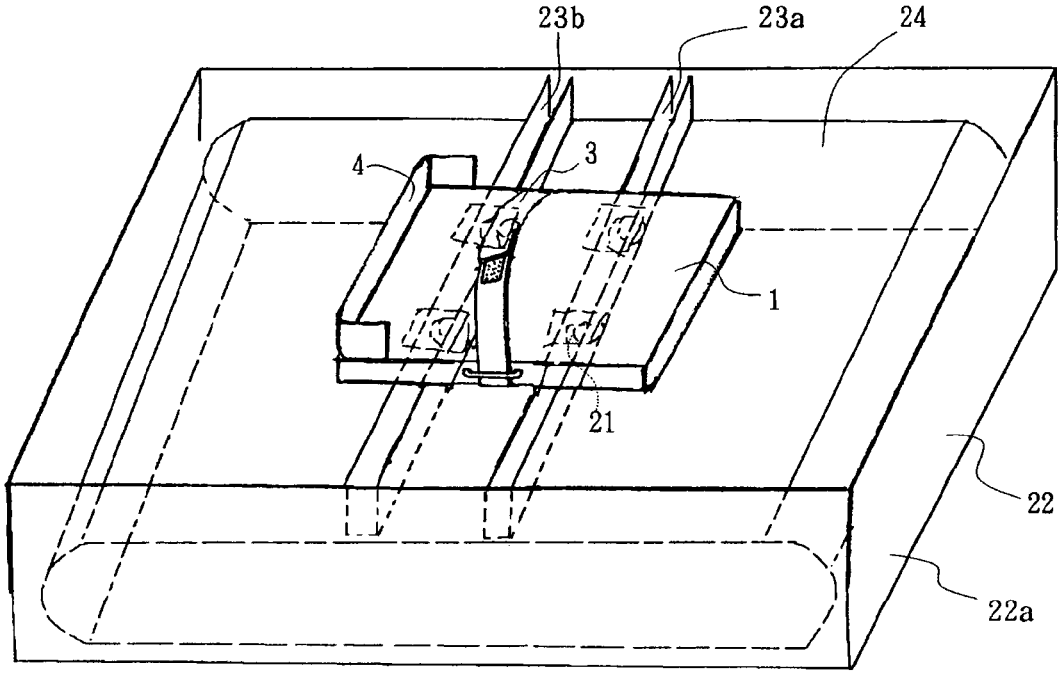
FIG. 11 is a perspective view of the 2nd embodiment.

FIG. 11 is a perspective view of the second embodiment.

Figure 12:
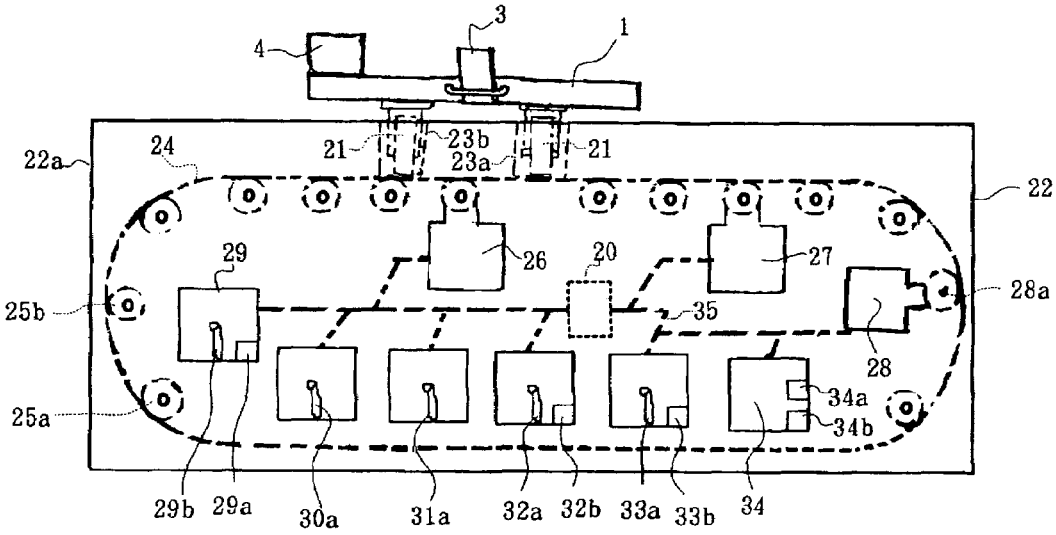
FIG. 12 is a side view of the 2nd embodiment.

FIG. 12 is a side view of the second embodiment.

Figure 13:
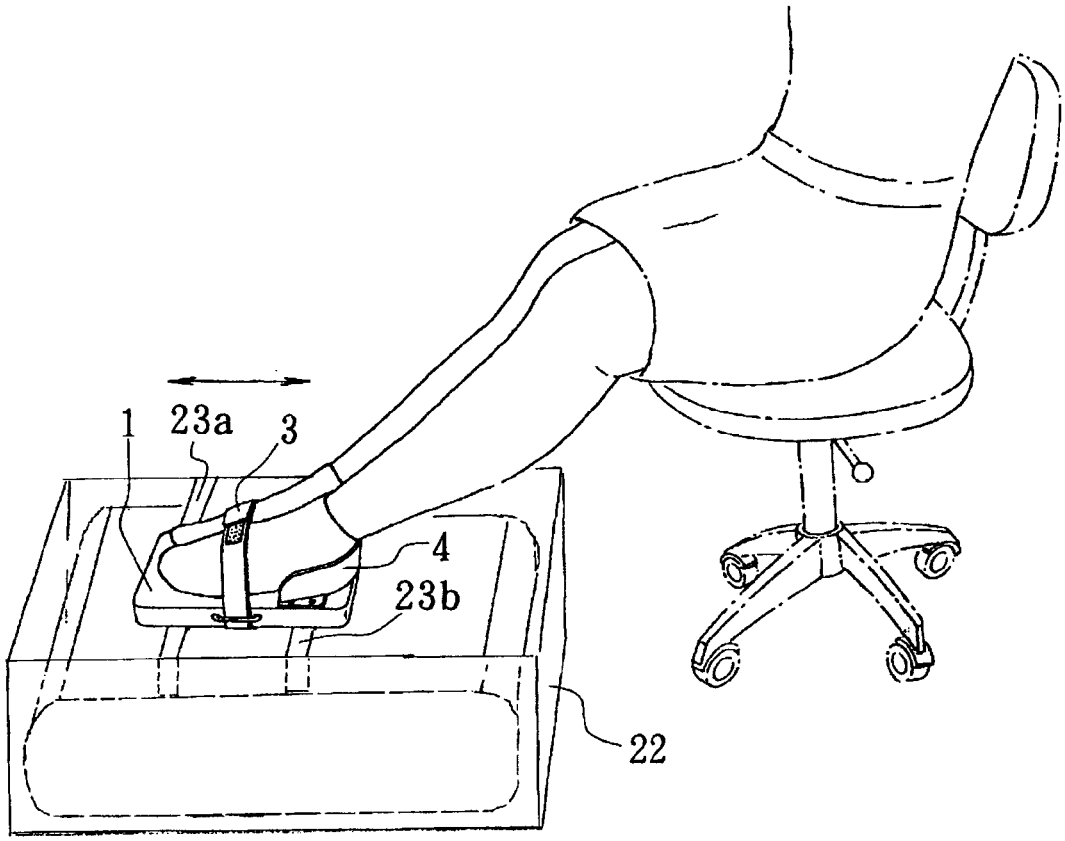
FIG. 13 is a perspective view of the 2nd embodiment in a usage state.

FIG. 13 is a perspective view of the second embodiment in a usage state.

Furthermore, I omit the detailed explanation of composition elements parity to the first embodiment by putting the same mark in the explanation of the second embodiment.

The second embodiment consists of a foot rest (1) and a foot rest cart (22) as a measuring instrument, and the similar functions to the first embodiment are realized by combining a foot rest (1) and a foot rest cart (22).

Same as the first embodiment, both a heel support part (4) and setting band (3) assemble a foot rest (1) of this embodiment.

Several wheels (21) that may move toward the right and left freely assemble an undersurface of a foot rest (1).

The lower limb function training device needs to restrict the movement in the right-and-left direction in order to detect the movement in a cross direction.

However, same as the first embodiment, the progression of an exercise tends to deflect the foot (51*a*) with a disability because of the strength of another healthy foot (51*b*) without any disability is strong due to setting both a foot (51*a*) with disability and another healthy foot (51*b*) without any disability.

In this case, it becomes a corrective exercise instead of a natural exercise by readjusting to move forward completely, and then the continuation of training and exercise might be difficult due to big loads applied to foot (51*a*) with disability.

Thereupon, wheels (21), which roll side-to-side, assemble on a foot rest (1) in order to eliminate the difficulty of the continuation of such training and exercise.

And, two pieces of the front side wheel (21) assemble and install in a wheel bearing (23*a*) on the front side of a foot rest cart (22), and two pieces of the rear side wheel (21) assemble and install in a wheel bearing (23*b*) on the front side of a foot rest cart (22).

The number of wheels (21) selection is available, if it is effective to move right and left.

The embodiment can be used as a corrective exercise when a training leader admits and a corrective exercise is necessarily needed.

A foot rest cart (22) consists of a box unit (22*a*), a top surface which is opened, wheel bearings (23*a*, 23*b*), a movable belt (24) with infinite form to cross direction movement, to which wheel bearings (23*a*, 23*b*) assemble, a derivation roller (25*b*) that guides the movable belt (24) and is supported to a box unit (22*a*) with a driving roller (25*a*) that drives the movable belt (24) and is supported to a box unit (22*a*) with available rotation, a speed sensor (26) (Parity to a speed sensor (16) of the first embodiment) as movement speed detection device, a number-of-times detection sensor (27) (Parity to a number-of-times sensor (18) of the first embodiment) as a round-trip movement number sensing device, a movable belt brake roller (28*a*), a brake (28) (Parity to a brake (17) of the first embodiment), a motor (29) (Parity to a motor (19) of the first embodiment) as a drive unit, a power switch (29*a*), an addition resistivity control switch (29*b*) (Parity to an addition resistivity control switch (7*e*) of the first embodiment), a coercive movement speed setting switch (30*a*) (Parity to a coercive movement speed setting switch (7*f*) of the first embodiment), a coercive reciprocating motion setting switch (31*a*) (Parity to a coercive setting reciprocating motion switch (7*j*) of the first embodiment), a speed setting switch (32*a*) (Parity to a speed setting switch (5*b*) of the first embodiment), an output device (32*b*), a reciprocating motion setting (33*a*) (Parity to a reciprocating motion setting (6*b*) of the first embodiment), a reciprocating motion output device (33*b*), a battery set part (34), a release switch (34*a*) (Parity to a release switch (7*i*) of the first embodiment) for all of control releasing, external power terminal (34*b*), an information transmission route (35) (Parity to an information transmission route (14) of the first embodiment) and control unit (20).

Furthermore, every part of the second embodiment effects similar process of parity parts of the first embodiment and details of process are omitted.

Although a box unit (22*a*) is made of plastic, however, wood or metal are substitutes, in which the part such as rollers (25) assemble inside, and any material of sufficient strength that is possible to protect the inside on the occasion of movement and application, is released without covering the upper part that is similar to a rectangle, is formed approximately to the height of 30 centimeters, 60 centimeters to the right and left, 1 meter long and is accommodated with a measuring instrument inside.

A movable belt (24) is composed with twelve movable belt derivation rollers (25*b*) and a movable belt driving roller (25*b*) to roll freely, makes a foot rest (1), which assembles to move in a cross direction horizontally on wheel bearings (23*a*, 23*b*) that were established to a movable belt (24) move in a cross direction and foot (51*b*) without any disability reinforce a foot (51*a*) with a disability by making lower extremities bend and stretch like the first embodiment, trains and also exercises knee (i) extension and ankle (ro) flexion and dorsiflexion by expanding a range of motion of knee (i) and ankle (ro)

A motivative exercise, assistive-passive exercise and a resistive exercise are realized.

A movable belt (24), which has durability, is formed with material that moves freely by movable belt derivation roller (25*b*) and movable belt driving roller (25*a*) by rolling.

Also, a brake roller (28*a*) contacts a movable belt (24) and is made to stop for braking, although, ordinarily, it is not contacting a movable belt (24).

A drive unit may be connected with a metallic chain structure, although a movable belt (24) is a synthetic fiber, which is weaved of metal.

Also, a movable belt (24) is good or any material that is transmitted or transmits rolling to a movable belt derivation roller (25*b*) and a movable belt driving roller (25*a*) by friction such as leather or fiber.

Twelve derivation rollers (25*b*) are assembled and rotate following a cross direction movement, which is moved by a foot rest, of a movable belt (24).

A speed sensor (26) assembles into one of the derivation rollers (25*b*) and a number-of-times detection sensor (27) assembles into another one of the derivation rollers (25*b*).

Furthermore, a brake (28) assembles into a movable belt brake roller (28*a*) and a brake is composed with a movable belt brake roller (28*a*) and brake (28).

In this enforcement either speed sensor (26), a number-of-times detection sensor (27) and brake (28) is assembled and divided into three rollers, but a speed sensor (26), a number-of-times detection sensor (27) and a brake (28) are possible to assemble in one roller.

A movable belt driving roller (25*a*) is connected to a motor (29), and the movable belt driving roller (25*a*) rolls by the operation of the motor (29), and a movable belt (24) and a foot rest (1) move in a cross direction along with the rolling of the movable belt driving roller (25*a*) and the assistive-passive exercise and a resistive exercise have been realized as in the first embodiment A speed sensor (26), which is a parity to a speed sensor (16) of the first embodiment, detects the movement speed of a foot rest (1) by detecting a derivation roller (25).

A speed output device (32*b*) is a socket that outputs detecting value of speed sensor (16) to the outside.

A structure of a serial port for DOS/V is made, but any kind of terminal is good if it is able to detect output value to the outside in the second embodiment.

A number-of-times detection sensor (27) detects a number of reciprocating movements of a foot rest (1) by detecting one piece of movement of derivation roller (25*b*).

A reciprocating motion output device (33*b*) is a socket that outputs detecting value by a number-of-times detection sensor (27) to the outside.

A structure of a serial port for DOS/V is made, but any kind of terminal is good if it is able to detect output numerical value of the number to the outside in the second embodiment.

A brake (28) for putting a movable belt (24) brake on and for making it stop is released by the signal from a release switch (34*a*).

Therefore, the brake (28) is not canceled, unless release switch (34*a*) is operated and the patient is not able to exercise once again.

A speed sensor (26) and also number-of-times detection sensor (27) are connected to the input side of a control unit (20) through an information transmission route (35) and a brake (28), a motor (29) and output device (32*b*, 33*b*) are connected to the output side through an information transmission route (35).

Also, an addition resistivity control switch (29*b*), a coercive movement speed setting switch (30*a*), a coercive reciprocating motion setting switch (31*a*), a speed setting switch (32*a*), a reciprocating motion setting (33*a*) and also a release switch (34*a*) are connected to a control unit (20).

And, the similar operation is performed, although it is different between the point that the movement of a foot rest (1) is carried out with a movable belt (24), while it is carried out with wheel (9,11) in the first embodiment.

It is not only a training device for effective motivative exercise, assistive-passive exercise and a resistive exercise available as the first embodiment, but also the structure to output value for available research, because it is able to detect an exact value about the movement around a reciprocating movement in a cross direction by using a movable belt (24) due to the obliqueness line being restricted in connection with detection value regarding reciprocating movement.

As mentioned above, lower limb function training device assemblies with a foot rest (1), wheels (21) that are composed in the lower surface and move and roll toward the right and left, wheel bearings (23*a*, 23*b*) that accept the wheels (21) in the condition of its movement is available toward the right and left and can make a reciprocating movement in a cross direction, a speed sensor (26) that detects the movement speed of the wheel bearings (23*a*, 23*b*) and brake devices that brake on the movement in the cross direction of wheel bearings (23*a*, 23*b*) when the mean value of the movement speed of direction, which speed sensor (26) detected or becomes a value of movement smaller than a maximum speed inside a regular interval set.

Therefore, the excessive exercise of a patient can be prevented, in case a patient gets tired due to setting a movement in the cross direction of a foot rest (1) to brake.

And also it can prevent giving the influence of movement in the right and left direction of a foot rest (1), so that a speed sensor (26) is detecting the movement in a cross direction of wheel bearings (23*a*, 23*b*).

As a result, speed sensor (26) can precisely detect the movement speed in a cross direction of wheel bearings (23*a*, 23*b*) or a foot rest (1).

Figure 14:
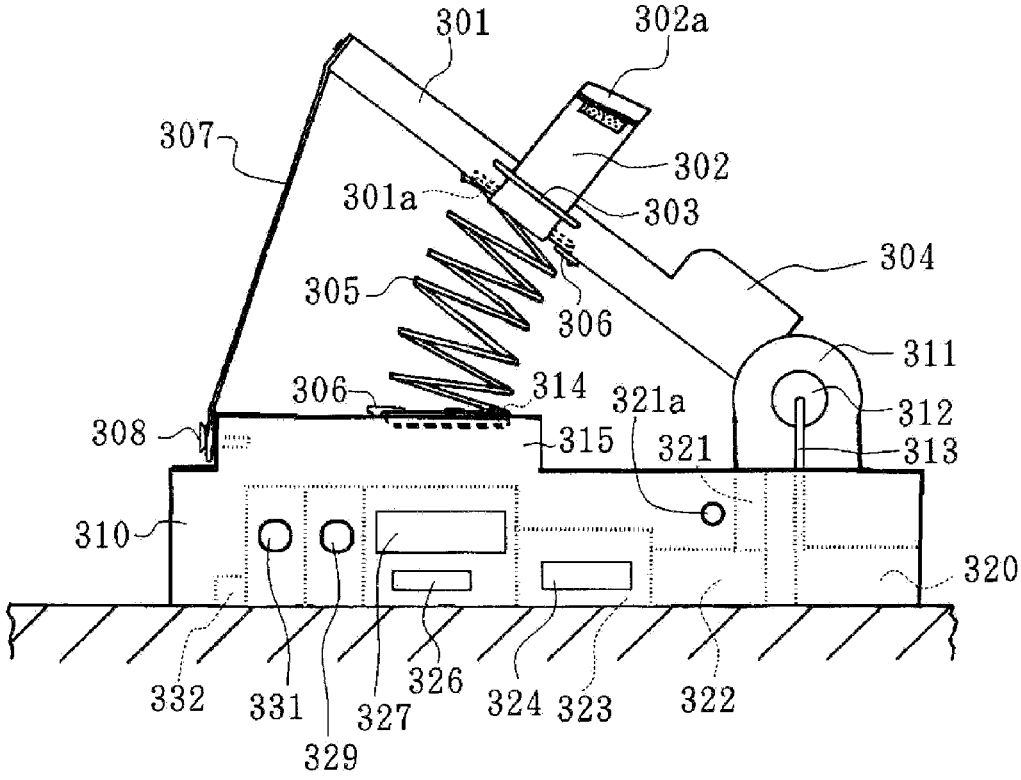
FIG. 14 is a side view of a lower limb function training device of the $3^{rd}$ embodiment.
Figure 17:
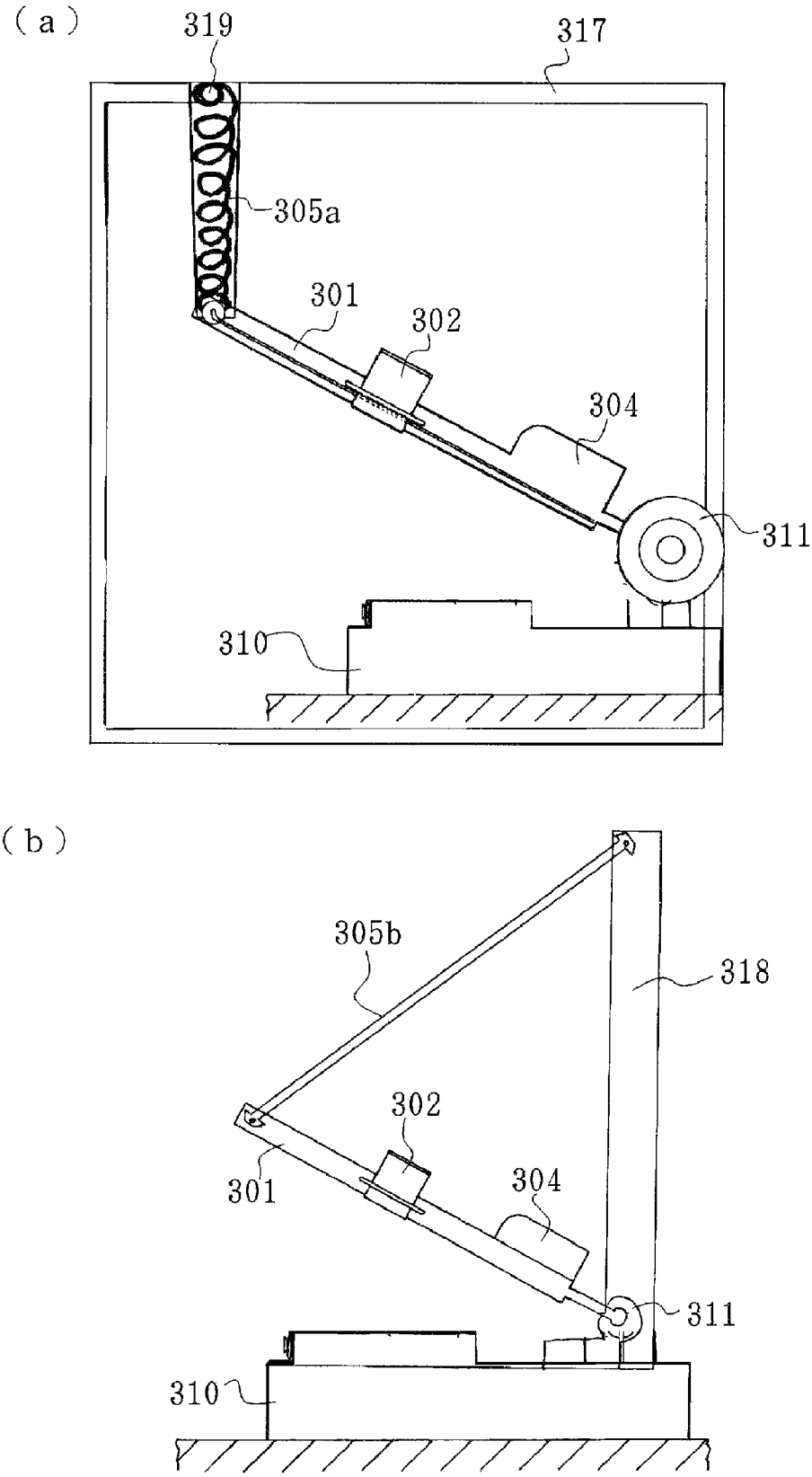
FIG. 17 is a side view of the modification of the 3rd embodiment, (a) is a view of the first modification, (b) is a view of the second modification.

Next, I explain the third embodiment by using FIG. 14 and FIG. 17.

FIG. 14 is a side view of a lower limb function training device of the third embodiment.

Figure 15:
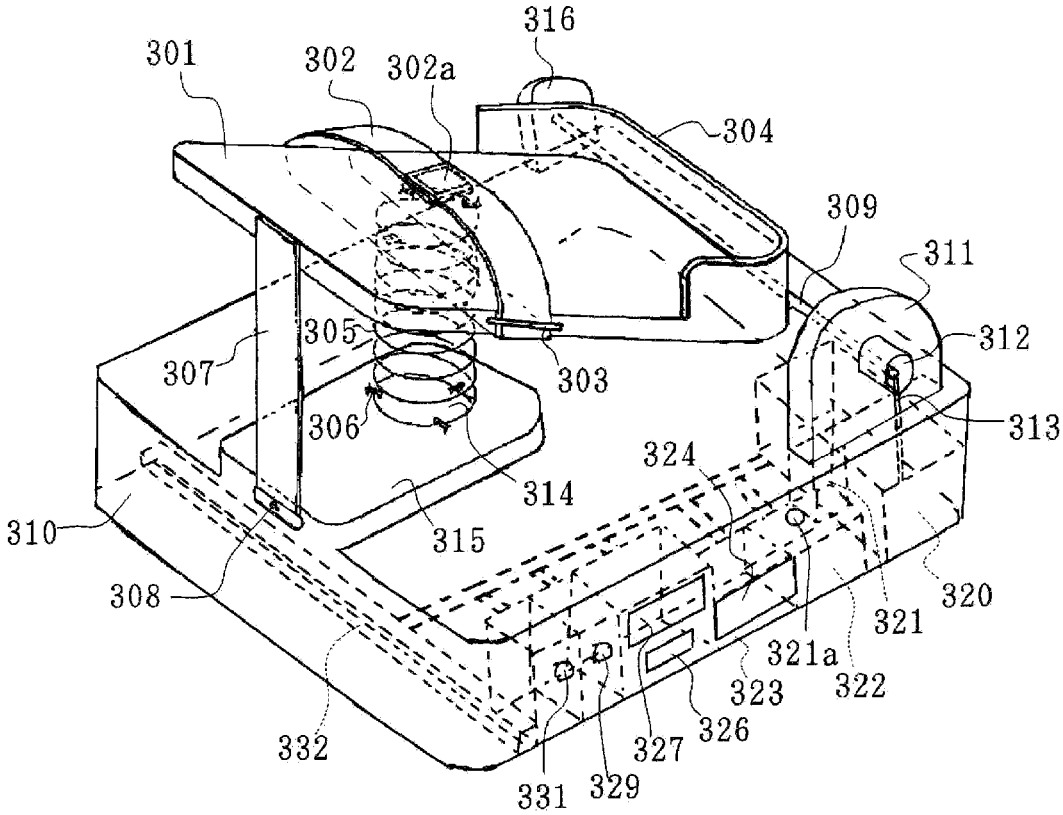
FIG. 15 is a perspective view of FIG. 14.

FIG. 15 is a perspective view of FIG. 14.

Figure 16:
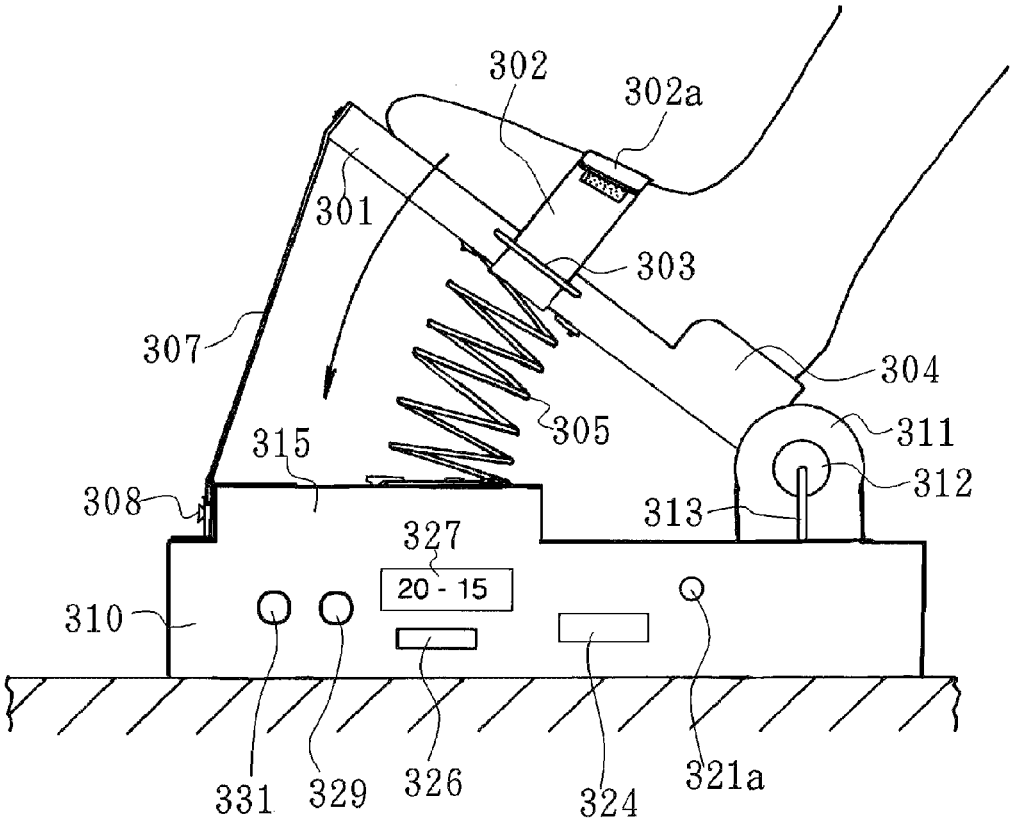
FIG. 16 is a side view while in use, which sets and fixes the two legs.

FIG. 16 is a side view while in use, which sets and fixes the two legs.

FIG. 17 is a side view of the modification of the third embodiment, (a) is a view of the first modification, (b) is a view of the 2nd modification.

A foot rest (301) is formed of plastic (or can necessarily be made of wood, etc.) and a space inside with a plane similar to a rectangle.

The foot rest (301) has an area of sufficient width that can set both feet shown as FIG. 16 (for example, the size of the side about 20 cm and about 25 cm, length).

Therefore, a disabled person can set both a foot with a disability, which has hemiparesis of lower extremities of a nerve, decline of the lower extremities muscular strength that originates from a plasmotomy of Achilles' tendon of any lower extremity, a disability in range of motion, etc. of an ankle or a knee of any bone fracture etc. and the other healthy foot without any disability in the condition of sitting on a chair, etc.

A heel support part (304) is composed of a foot rest (301) as a unit.

It impedes a movement to the rear of the heel of the two feet shown in FIG. 16.

Furthermore, in the case that a foot rest (301) is formed of wood, etc., a heel support part (304) can be composed with separated parts.

And also, a setting band (302) that the edge part of the right and left was adhered to a foot rest (301) is set up both with the interval from this heel support part (304) to the front and approximately the central position in the long hand direction of a foot rest (301).

A setting band (302) sets through the undersurface of a foot rest (301), both end parts of which pass conducive brackets (303), which is a plane Japanese letter (ko) character form, respectively, and which assemble in each right and left aspect of a foot rest (301) and are kept upward of a foot rest (301).

And both right and left end parts (302*a*) of setting band (302) are overlapped mutually and are engaged by proper engaging means such as a velvet-fastener, snapshot, hook, etc.

Also, the setting band (302) is composed of one setting band, it is able to be composed of two setting bands, end parts of which are fixed in a foot rest (301).

The setting band (302) is impeding the movement to both feet from the upper and front side shown in FIG. 16.

This securing tools to hold both feet in a foot rest (301) as shown FIG. 16 are composed by the heel support part (204) and the setting band (302).

The structure and material etc. of securing tools (302,304) are possible to change suitably, if both feet can be kept and set on a foot rest (301) as shown in FIG. 16.

At the condition that a patient recovered and power of each can be put in to both legs, the securing tools to both legs may be unnecessary.

A load device (305) is composed with the lower part of a foot rest (301).

A load device (305) is a material of a spring that can be replaced in the third embodiment.

Spring material as the elastic body of a load device (305) in the third embodiment is a load device, which adapts to a motivative exercise and gives the load repelled by total power (for example, about 20 kg) of weight of the foot (for example, about 15 kg) and power of applying a load in front of the foot (for example, about 4 kg).

The load, for which about 20 kg is exceeded, in the case of non-motivative exercise but a resistive exercise and also muscular strength exercise especially is sufficient according to a patient's situation.

Though a load device of FIG. 14 or FIG. 16 is a compression spring, a load device of FIG. 17 (*a*) is a tensile spring (305*a*) and a load device of FIG. 17*b* is a flexible band (305*b*) such as an elastic cord, which pulls up a foot rest (301).

The load device (305) is fixed in three places at a setting concave portion (301*a*), which is composed almost in the center of an undersurface of a foot rest (301), by mounting screws (306).

The other side is fixed in three places at a setting concave portion (314) that is composed in the upper part of a mounting convex protrusion (315) of a lower limb function training device cover (310) by mounting screws (306).

A gradient angle defined supporting device (307) is a cord.

An angle, which is the horizon, of a foot rest (301) has a range from 0 degrees of the minimum angle to 37 or 38 degrees of the maximum angle to a desirable angle of a motivative exercise by the gradient angle defined supporting device (307).

And, a foot rest (301) becomes possible to move in this range.

The upper part of a gradient angle defined supporting device (307) is glued on a foot rest (301).

The lower part of a gradient angle defined supporting device (307) is fixed at the upper part of a mounting convex protrusion (315) of a lower limb function training device cover (310) by mounting screws (308) and it becomes easy to fix a load device (305) by mounting screws (306).

A foot rest (301) is held with both a brake storage bearing (311) and a bearing part (316) of a lower limb function training device cover (310) to a foot rest turn part (309), which is fixed to out side of a foot rest (301) as a unit with the center freely pivoting.

A foot rest turn part (309) perforates a brake storage bearing (311) and an accelerometer (312) is assembled at the end of a foot rest turn part (309).

As well, a lower limb function training device assembles to control unit (320), which is composed of a microcomputer etc, an accelerometer (312) is composed on the input end of the control unit (320) through information transmission route (313) and in the other hand a brake (321), a motor (322) as a drive unit, a display unit (327), an antenna (332) and an output device (326) are composed on the output end of it through the information transmission route.

In addition, although an antenna (332) and an output device (326) do not necessarily need to be included, the detection value etc. of an accelerometer (312) can be output outside by this antenna (332) and output device (326).

An accelerometer (312) detects the acceleration at the time when a foot rest (301) is trodden downward.

The detected acceleration is transmitted to the control unit (320), which consists of a microcomputer, through the information transmission route (313).

In a control unit (320), whenever the signal of acceleration is input from an accelerometer (312), it has counted, and the number of times of rocking of a foot rest (301) is generated.

And a control unit (320) memorizes the acceleration, which is input from an accelerometer (312) and the number of times of rocking of a foot rest (301) as data in memory department, and outputs it suitably if needed.

Moreover, control unit (320) has the acceleration control function, in the case that the acceleration, which is detected with an accelerometer (312), exceeds the acceleration of a regular standard value that is the setting value set up beforehand (for example, the maximum acceleration for every fixed time) or a switch (331) that was the setting acceleration value set up beforehand outputs an alarm signal and makes an alarm device drive.

For example, it can sound a buzzer or flash an indicator display unit (327) and/or transmit data from antenna (332).

With this alarm, a caregiver can change the strength of the load device (305) into optimum setting.

Furthermore, as mentioned above, control unit (320) is counting the number of times of rocking of a foot rest (301), and outputs a stop signal to brake (321) when this number of times of rocking of a fixed standard (for example, about 20 times) or the number, which was set up with a setting switch (329), is exceeded.

If a stop signal is received, brake (321) brakes a foot rest turn part (309), and will stop rocking.

In the case of the third embodiment, switch (321*a*) is operated manually and this brake (321) is canceled.

Because it is used with changing a switch, it is a consideration that patients do not exercise excessively, continually and easily.

An exercise is impossible again, without releasing a brake.

Although a display unit (327) in the third embodiment is a digital display screen, as long as it can display the number of times of rocking, display of acceleration, warning etc., any kind of display device may be used.

Moreover, any kind of forms is sufficient although an output device (326) in the third embodiment is 10 base T.

Although an antenna (332) outputs the acceleration and the number of times, which were inputted and also can set an acceleration, number of times of rocking etc. to a control unit (320) with a remote control when applying a brake (321).

A battery storage part (323) shows a storage part of a battery.

Moreover, an input part (324) of external electric power is also formed.

A charge method or a non-charging method is also possible for the battery.

And when a battery is used as a charge method, it is possible to charge from an input part (324) of external electric power supply.

Moreover, it is also possible to make a foot rest (301) rock compulsorily by a motor (322).

For example in the case that there are hemiparesis after apoplexy, a decline of muscular strength of the lower extremities is caused by the rupture of the Achilles' tendon and/or disabilities of the range of motion in ankle originating in a bone fracture of the lower extremities, both feet are set and fixed in a foot rest (301) by setting together heels of both feet one with a disability and another healthy foot without any disability to heel support part (304) and attaching foot tip by setting band (302) strapping both feet, fixed in the sitting position because of the third embodiment of lower limb function training device assembled as stated (Refer to FIG. 16).

Thus, it is able to set and put on both feet with the upper surface of a foot rest (301) corresponding to the size of a disabled person's feet easily, because it is good that heels are set and put on to heel support part (304), setting band (302) sets and attaches foot tip in order to set and fix both feet with a foot rest (301).

Herewith, the training is done with rocking a foot rest (301) in the direction as shown with the arrow of FIG. 16 by gradually adding power while controlling subjective movement for making lower extremities expansion and contraction, muscular strength of lower extremities reinforces and flexion and dorsiflexion of lower extremities by expanding a range of motion of those due to healthy foot assisting a foot with a disability by not increasing a burden.

The example shown in FIG. 17 (*a*) shows that it is possible not to load from a lower part like the spring material of the load device (305), but to load a way from the upper part by pulling up.

A frame (317) is a frame body that is able to include a lower limb function training device and a heel setting part is an opening space and is needed in order to use freely.

Moreover, it is good that security materials (319), which are crossed to both side covers of frame (317), are sufficient to have the strength to assemble a load device (305*a*), for example, about 60 kg in order.

The example shown in FIG. 17 (*b*) is used to install a pillar near heels and it is possible for a load device (305*b*) to be assembled.

Either one or two pillars (318) are sufficient as long as it has the intensity, which does not break, for example, when it pulls by almost 60 kg in order that it assembles a load device (305*b*).

In the third embodiment, a load device (305), which is a spring, can be any kind of material, which can apply a load such as oil pressure, air pressure and elastic pressure and also has rebounding power.

The effect of such an exercise is connected to the improvement of disabilities.

However, disabled persons, who desire to recover as soon as possible even one day earlier, exercise many times and then may exceed the range of proper quantity and may exercise.

Therefore, the improvement that is expected may not be sometimes obtained.

So that there is no such case, a number that should be exercised to a proper value is regulated by operating a brake (321) with control unit (320).

The number can be set for approximately 10 times minimum to 50 times maximum into a control unit (320) by operating a setting switch (329).

And, a control unit (320) causes a brake (321) to be operated, when it becomes the setting number and suspends rocking of a foot rest (301).

Figure 18:
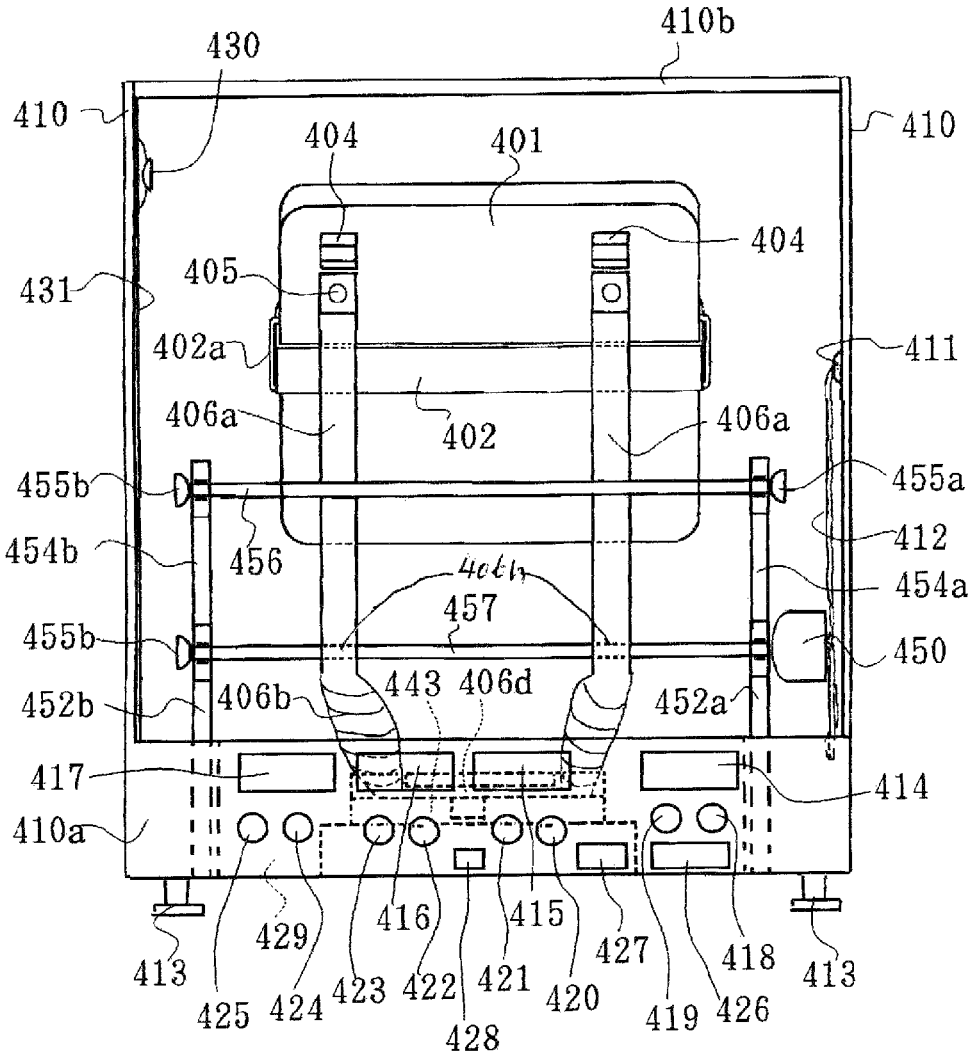
FIG. 18 is the front view of a lower limb function training device of the fourth embodiment.
Figure 22:
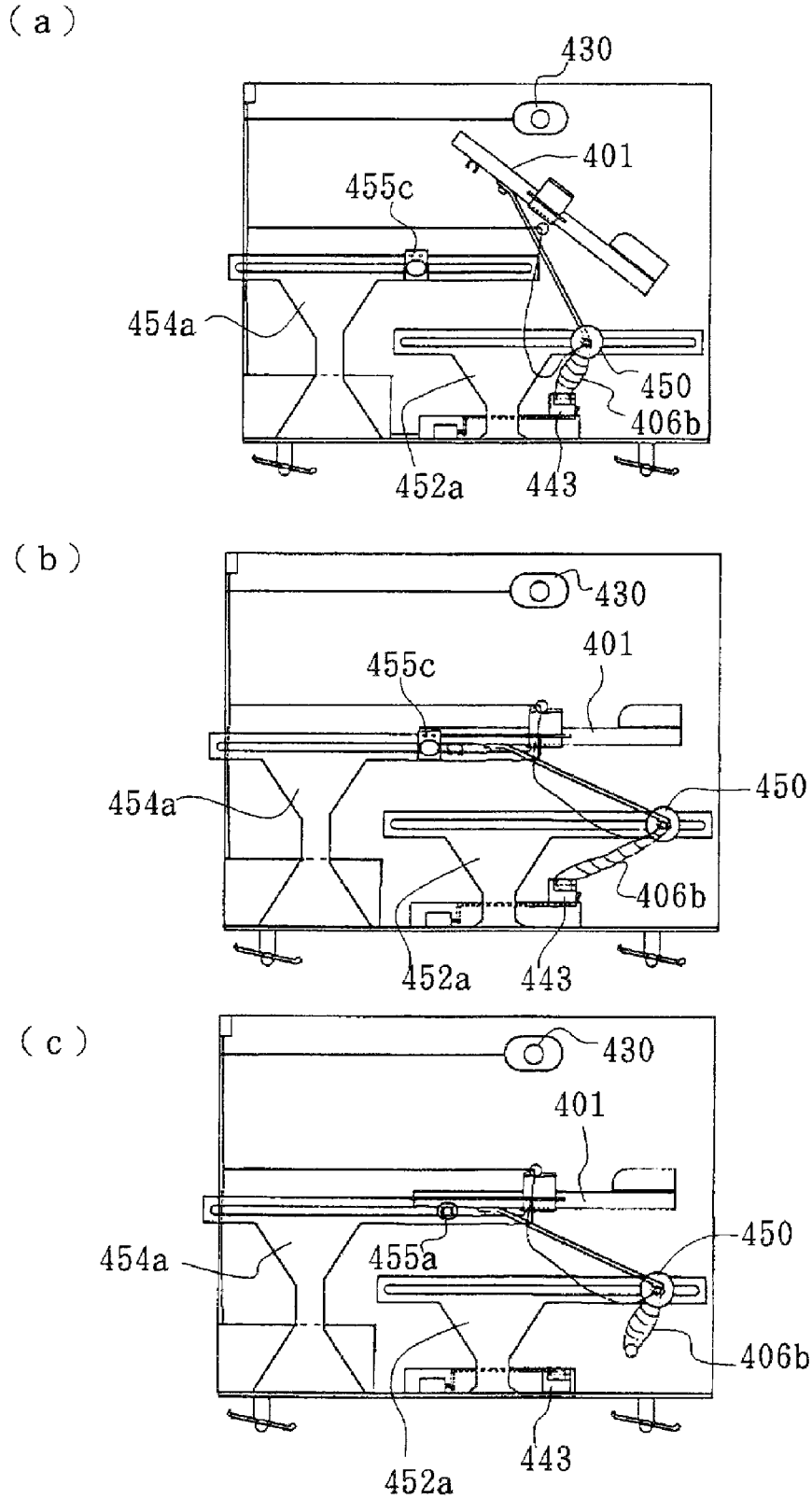
FIG. 22 is an explanation diagram of the fourth embodiment, (a) is a figure of the upper maximum limit at the time of rocking in the vertical direction, (b) is a figure of the bottom minimum limit at the time of rocking in the vertical direction and (c) is a figure at the time of a reciprocating motion in the direction of order.

I explain the fourth embodiment of a lower limb function training device in this invention by using FIG. 18 or FIG. 22.

FIG. 18 is the front view of a lower limb function training device of the fourth embodiment.

Figure 19:
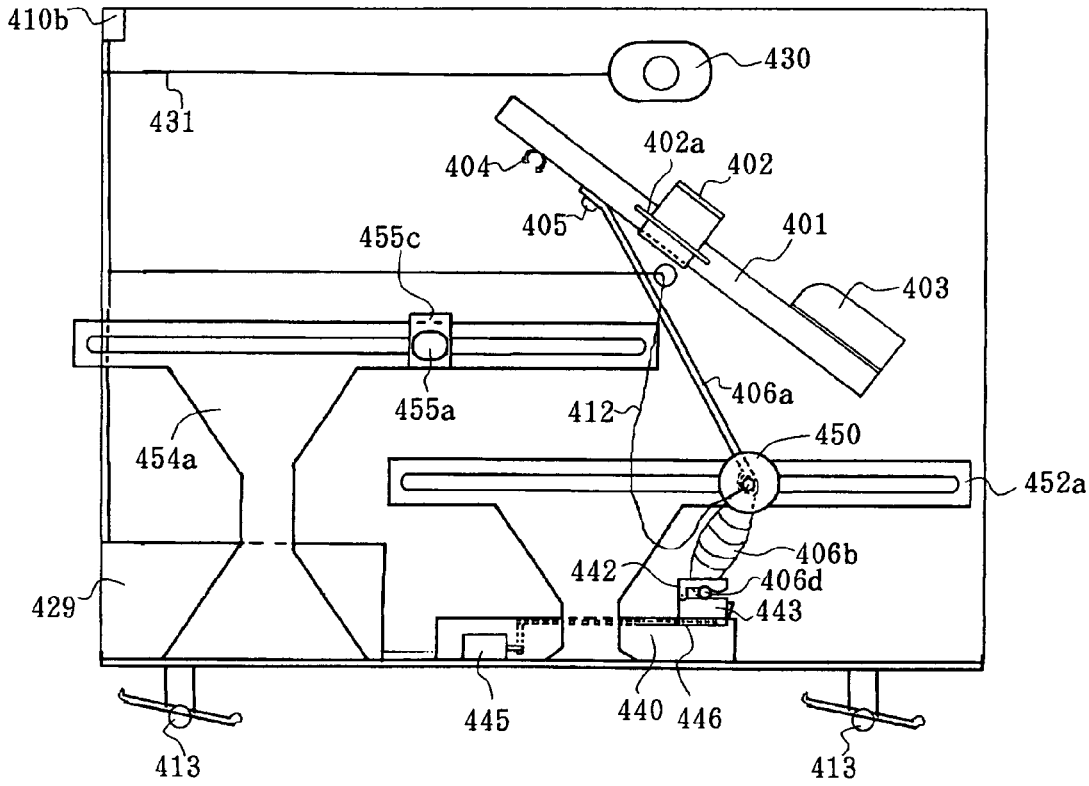
FIG. 19 is a side view of a lower limb function training device of the fourth embodiment.

FIG. 19 is a side view of a lower limb function training device of the fourth embodiment.

Figure 20:
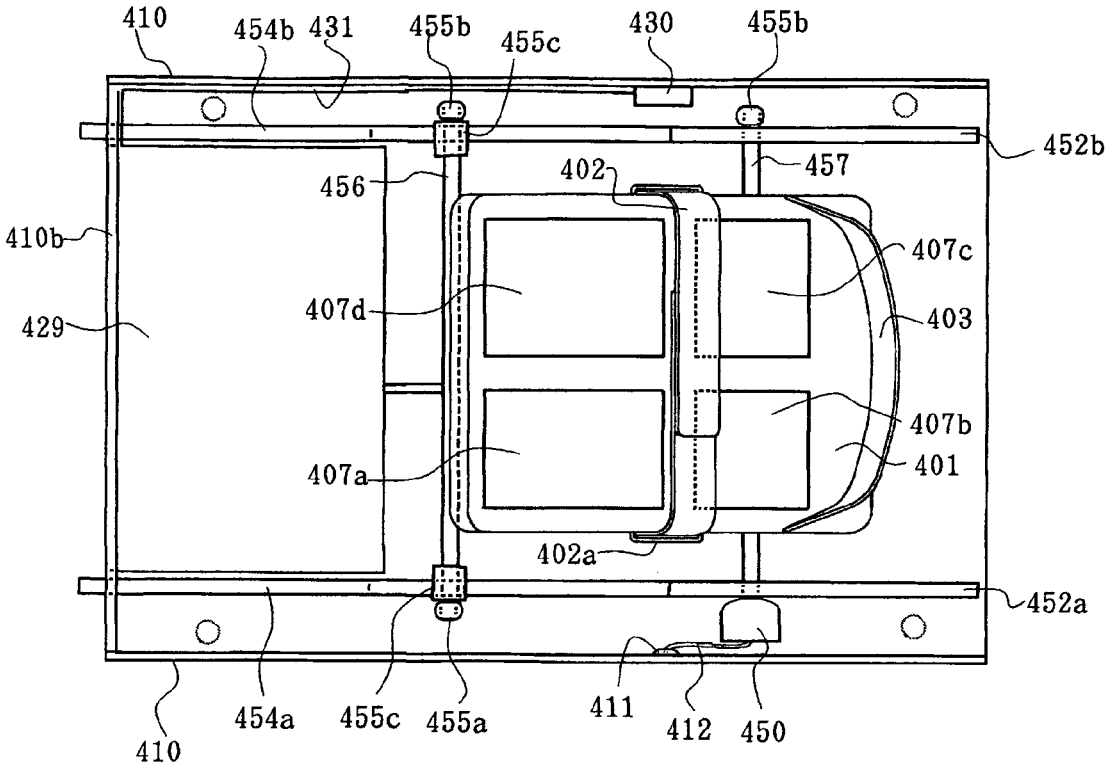
FIG. 20 is a plane view of a lower limb function training device of the fourth embodiment.

FIG. 20 is a plane view of a lower limb function training device of the fourth embodiment.

Figure 21:
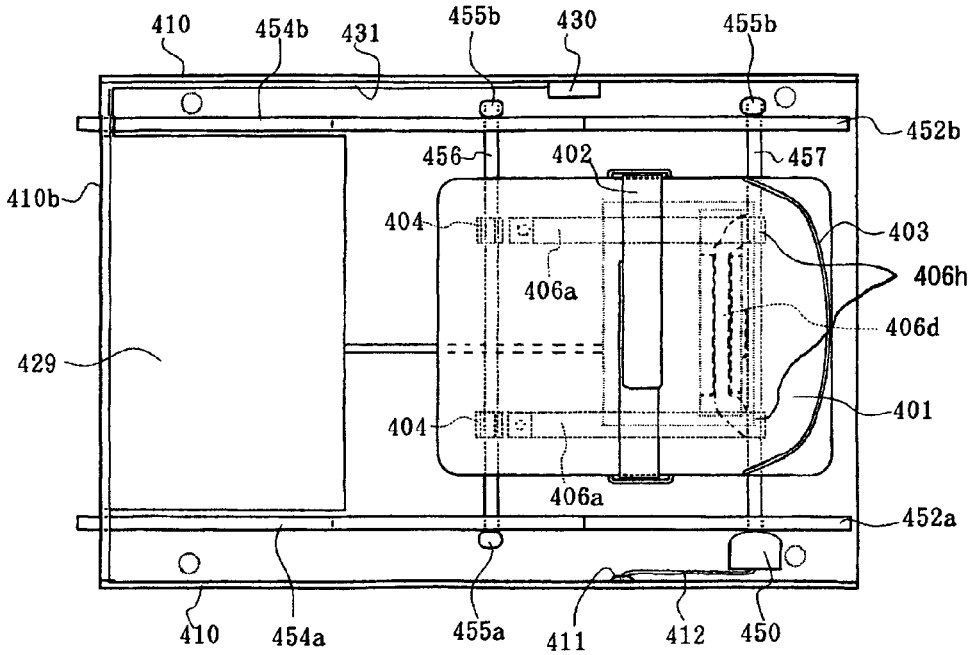
FIG. 21 is a plane view in the usage state of the reciprocating movement, front and back, of the fourth embodiment.

FIG. 21 is a plane view in the usage state of the reciprocating movement, front and back, of the fourth embodiment. Furthermore, the contact sensor has been omitted in FIG. 21.

FIG. 22 is an explanation diagram of the 4th embodiment, (a) is a figure of the upper maximum limit at the time of rocking in the vertical direction, (b) is a figure of the bottom minimum limit at the time of rocking in the vertical direction and (c) is a figure at the time of a reciprocating motion in the direction of order.

A foot rest (401) is formed of wood with a plane similar to a rectangle (or by any necessity, such as plastic).

A foot rest (401) is similar to a foot rest of the first embodiment or the third embodiment.

It has an area of sufficient width that both feet can be set upon (for example, the size of the side of about 20 cm about 25 cm, length).

Therefore, a disabled person can set both a foot with disability, which has hemiparesis of lower extremities of a nerve, decline of the lower limbs extremities muscular strength that originates from a plasmotomy of Achilles' tendon of any of lower extremities, a disability of a range of motion, etc. of an ankle, and also a knee of any bone fracture etc. and a foot of the other healthy foot without any disability in the condition of sitting on a chair.

A heel support part (403), which is formed by belt like things, such as plastic, skin and cloth, is similar to the heel support parts of the first embodiment or the third embodiment.

It is almost shaped like a letter C shown in a plane view and then is fixed with tack wear, nail wear, screws etc. to an upper part of a rear surface of a foot rest (401) and impedes a movement to the rear of both heels, in the case that both feet are kept on the surface of a foot rest (401).

Furthermore, in the case that heel support part (403) is formed from plastic, it may form a unit to a foot rest (401).

And also, a setting band (402) that the edge part of the right and left was adhered to a foot rest (401) is set up both with the interval from this heel support part (403) to the front and almost to the central position of the long hand direction of a foot rest (401).

A setting band (402) sets through an undersurface of a foot rest (401), both end parts which pass conducive brackets (402*a*), which is a plane Japanese letter (ko) character form, respectively, and which assemble in a right and left aspect of a foot rest (401) of each and are keeping upward of a foot rest (401).

And both right and left end parts of band setting band (402) are overlapped mutually and are engaged by a proper engaging means such as a velvet fastener, snapshot, hook, etc easily.

However, the setting band (402) is composed of one setting band, it is available to be assembled of two setting bands, end parts of which are fixed in a foot rest (401).

The setting band (402), which covers insteps of both feet from upper side, is impeding the movement to both feet from the upper and front side.

Securing tools (402. 403) that hold both feet in a foot rest (401) are composed of the heel support part (403) and the setting band (402).

The structure, material etc. of securing tools (402.403) are possible to change suitably if both feet can be kept and set on a foot rest (401).

As well, at the condition that a patient recovered and each power can be put in to both legs, the securing tools to both legs may be unnecessary.

A foot rest support part (406*a*) is composed to each of right and left side to the front lower part of a foot rest (401) by foot rest support security screws (405).

A hole (406*h*) of a cross-sectional similar round shape perforates and is formed to the lower end part of a foot rest support part (406*a*).

Rotation is available with a rear support axis (457), which is arranged in the direction of order horizontally to the hole (406*h*), and is inserted.

Therefore a foot rest support part (406*a*) can rock to a rear support axis (457) and on the other hand a rear support axis (457) can rotate to a foot rest support part (406*a*).

Also a load device (406*b*), which consists of a haul spring etc., assembles a lower end part of a foot rest support part (406*a*) and the load device (406*b*) forces in the direction where the front of a foot rest support part (406*a*) pops up.

And a rear support axis (457) assembles in the long holes, which assemble both axis supporting structures (452*a*, 452*b*) of right and left, as a slide part, with rotation and sliding possible.

And a rear support axis (457) is held by screwing a hold axis clasp (455*b*) on one edge to stop it from coming out with an accelerometer (450) at the other edge.

Long holes of axis supporting structures (452*a*, 452*b*) are assembled parallel to the base of a lower limb function training device.

Hereafter a rear support axis (457) can rotate and slide in a cross direction and also becomes a pivot axis in the case that both foot rest (401) and a foot rest support part (406*a*) rock.

A patient sets feet on a foot rest (401), presses it downward with forced resistance of a load device (406*b*), decreases a downward power to the foot rest (401) and moves a foot rest (401) up with a force from load device (406*b*).

Then the patient presses it downward with forced resistance of a load device (406*b*).

Thus, rocking in the vertical direction is repeated.

Also, a rear support axis (457) moves in a reciprocating motion in a cross direction from the position of the foreside as shown in FIG. 20 to the rear position as shown in FIG. 21 when a foot rest (401) rocks in a vertical direction.

An accelerometer (450) detects an acceleration of a reciprocating movement in a cross direction of a rear support axis (457) about one direction (forward direction or backward direction).

The detected acceleration is transmitted to a control unit (429), which consists of a microcomputer, through an information transmission route (412).

A control unit (429) counts and generates numbers of reciprocating motion of a foot rest (401), whenever the signal of acceleration is inputted from an accelerometer (450).

And a control unit (429) memorizes an acceleration input from an accelerometer (450) and the number of reciprocating motion of a foot rest (401) in a memory part as data and outputs it suitably if needed.

And it does not use the acceleration but can also use speed and the number of new speed occurrences by detecting one-directional speed.

Also, an axis hold part (404), which engages a clutch freely to a foreside support axis (456) assembles at the front of a foot rest support part (406*a*) to a front lower part of a foot rest (401).

A foreside axis hold part (404) is a structure, which can keep a foreside support axis (456) rotating freely; structure bears load of a foot rest (401) having and can secure a foot rest (401) horizontally.

In the fourth embodiment a structure can also secure a foreside axis hold part (404) with a pin, wire, etc. after a foreside support axis (456) fits in, but also any kind of structure is good that can bear a load and can secure horizontally.

Each of four sheets of contact sensors (407*a*, 407*b*, 407*c*, 407*d*) assembles vertically and horizontally to the upper surface of a foot rest (401) and these contact sensors (407*a*, 407*b*, 407*c*, 407*d*) detect when anything contacts it and outputs a detection signal.

Although a foot rest (401) assembles upward with the angle of about 40 degrees and upward.37.5 degrees in the fourth embodiment, healthy feet, which are set, contact sensors simultaneously.

However, feet with contracture cannot contact simultaneously.

With contact of the foot tip and heel the foot with contracture is detected, changes in the angle of a foot rest (401) as degree of horizontality by contact sensor (407*a*, 407*b*, 407*c*, 407*d*), data is transmitted through information transmission route (412), such as an electric wire.

By our research, it was confirmed that the movement of a foot rest (401) in a cross direction and a vertical direction begins an ankle plantar Flexion of 37 degrees and makes a knee flexion of 118 degrees possible.

Thereby it is able to evaluate the angle of the joint of motion of a patient who has contracture due to motivative exercise by a patient's own self or a passive exercise by a caregiver.

The exterior of the fourth embodiment is a unit structure and consists of transparent plastic.

The front and the rear surface is an open space so that prevention of exercise may not be carried out.

A front lower part (410*a*) is opaquely painted to assemble a switch part.

A communication-information stability assembly device (411) assembles as an information transmission route (412) and is composed steadily in the right side of an aspect part (410).

A camera (430) and an information transmission route (431) assembled in the left aspect part.

An antenna (410*b*), which inputs and outputs information assembles to the front upper part and since this antenna (410*b*) has connected both an aspect part (410) at the upward and foreside mutually it achieves the purpose to strengthens structure.

A caster (413) with sled assembles in four corners in the lower part of the base, respectively.

An information transmission route (412) is composed of an electric wire and transmits a signal that is detected with an accelerometer (450), which moves in a cross direction.

An information transmission route (412) may be composed of a radio signal that can be transmitted.

A camera (430) formed in the left side is an artificial retina camera and while it takes a photograph of a large domain simultaneously, it can detect photography data continuously.

This shooting data is input to a control unit (429) through an information transmission route (431) and a control unit (429) and can output this shooting data as it is or is processed.

While an output is made to display units (414,415,416,417 etc.), it can perform an external output from an external information output terminal (427) and an antenna (410*b*).

Although a camera (430) is an artificial retina camera in the fourth embodiment, any camera is good that is able to detect shooting data continuously and shoot the wide range simultaneously as a ccd camera and a video camera, etc.

The contact sensors 407*a*, 407*b*, 407*c*, 407*d* detect contact simultaneously and this detection signal is input to a control unit (429), then control unit (429) outputs a drive signal in camera (430) of a left side aspect part.

A camera (430) shoots when it receives a drive signal and output shooting data to control unit (429).

Since an artificial retina camera is used in the fourth embodiment it can recognize easily the outside of the object taking a photograph, it can process and output the angle of a foot rest (401), which took a photograph and the angle of the joint of a patient's lower extremities as angle data in control unit (429).

In the case that these angles, etc. are detected in the fourth embodiment, a caregiver moves a foot rest (401) manually.

A control unit (429) assembles in the front lower part of the exterior in which it was painted.

In the front lower part of the exterior, in which control unit (429) is composed, a number indicator display unit (414), an angle indicator display unit (415), an acceleration indicator display unit (416), an exercise kind display unit (417), a motion times setting switch (418), a reset switch (419), an angle investigation switch (420), an angle manual change switch (421), an acceleration setting switch (422), an exercise selection switch (423), a manual camera shutter switch (424), a power-supply switch (425), an external information output terminal (427) and an external information input terminal (428) are assembled.

A control unit (429) performs control.

A number indicator display unit (414), an angle indicator display unit (415), an acceleration indicator display unit (416) and an exercise kind display unit (417) or any display is good, such as a data display rotating drum, if data can be displayed, although they use digital display equipment.

A control unit (429) uses a microcomputer.

All the devices are tied with an information transmission route.

A foreside support axis (456) assembles in the long holes, which assemble both axis supporting structures (454*a*, 454*b*) of the right and left side, as a slide part that rotates and is able to slide.

The foreside support axis (456) is held down by screws with hold axis clasps (455*a*, 455*b*).

Long holes of axis supporting structures (454*a*, 454*b*) are parallel to the base of a lower limb function training device.

Also, a foreside support axis (456) is fixed with a motionlessness help device (455*c*) to halt stability in the optional place of a long hole and can halt it.

As shown in FIG. 22 (*b*), a foreside support axis (456) touches and impedes descent of a foot rest (401) if a foot rest (401) drops to a minimum descent so that a foot rest (401) does not travel below the lowest end of a foot rest (401) and rocks in the vertical direction.

A foreside support axis (456) is fixed with a motionlessness help device (455*c*) and halts.

As shown in FIG. 22 (*b*), a halted foreside support axis (456) works as a hold axis to halt, which supports the front of a foot rest (401) at the position other than hold axis clasps (455*a*, 455*b*), in other words the position which does not become obstructive to axis hold part (404).

When a foot rest (401) exercises the cross direction of order, in order to be able to exercise in movement of a foot rest (401) with the installation side of lower extremities function training device nearly parallel, as shown in FIG. 21 and FIG. 22 (*b*), a foot rest (401), of which the front part is supported with a foreside support axis (456) and the rear part is supported with another rear support axis (457), slides in the cross direction of order almost parallel with the foreside support axis (456) and the rear support axis (457) rotates.

Thus, a parallel movement exercise can be carried out with a patient's motivative exercise.

In the case of this reciprocating movement in a cross direction, a hook (442) keeps a connection part material (406*d*) free and the load of a load device (406*b*) does not load.

(However, it is possible to add a load by other means, for example, a load device such as spring is attached freely and separately.)

It is possible to assemble a linear-drive motor in axis supporting structures (454*a*, 454*b*), to give a magnetic field to a rear support axis (457), to drive the linear-drive motor of a rear support axis (457) and also to make a foot rest (401) drive forward and backward.

Moreover, it is also possible to assemble a motor as a drive unit, which makes a foot rest support part (406*a*) rock to a rear support axis (457).

In such a case, a load device (406*b*) is omissible.

By carrying out load to a rear support axis (457) with the linear motor, it is able to load to the cross direction movement of a foot rest (401).

In addition, it is also possible to compose a load device, such as a spring, separately in a cross direction movement of a foot rest (401).

It is possible to apply a load of a rock in the vertical direction of a foot rest (401), by applying a load of a rock of a foot rest support part (406*a*) with a motor.

It is possible to use it as a training machine for a resistive exercise due to applying a load to a rear support axis (457) by a mechanical self-propelled movement of a rear support axis (457) or an electrical self-propelled movement by using a motor, etc., even without a linear motor.

Moreover, in the case of rocking in the vertical direction, it is necessary for a motivative exercise that a foot rest (401) needs to attach almost 37 degrees upwards, top direction toward foot tip part from heel part, the realization can be attempted even when there is not a load device (406*b*).

Although the load function is given to a rear support axis (457) in the fourth embodiment, the load function of the direction of order can also be given and controlled on a foreside support axis (456).

In the case that a foot rest (401) moves in the cross direction, although, the height of a rear support axis (457), which locates the lower part of a load device and a foreside support axis (456), which is positioned in different heights, locates the upper part to carry out parallel movement.

A foot rest support part (406*a*) may be made of material such as plastic, etc., that can support loads, although, it is the one unit structure made from steel in the fourth embodiment.

Separate structures are sufficient as structure.

Although a load device (406*b*) uses a spring of steel, if a load can be applied to maintenance axes (456,457), it does not need to be a spring.

Anything is sufficient if applied as a load such as oil pressure, air pressure, etc., in the case of separate structures.

Nothing else is needed when using the linear motor, etc.

The lower end part of load devices (406*b*) of both right and left sides is connected with a connection part material (406*d*) mutually and this connection part material (406*d*) is attached with an up-down system (443) freely by an electromotive hook (442).

Therefore, loading power of a load device (406*b*) can be certainly applied to a foot rest support part (406*a*).

A drive mechanism (440) that drives an up-down system (443) assembles in the bottom of the exterior of a lower limb function training device.

A drive mechanism (440) consists of a motor (445) as a drive unit and a power transmission device (446).

A power transmission device (446) consists of a combination gear mechanism.

This power transmission device (446) is for making an up-down system (443) make vertical movements and may use power transmission mechanisms, such as a chain and a belt, and may make an up-down system (443) make vertical movements by oil pressure, air pressure, etc.

At the time of a connection part material (406*d*) is assembled to an up-down system (443), a caregiver operates hooks (442) on right and left sides manually and holds down both side parts of a connection part material (406*d*).

As shown in FIG. 21, a foot rest (401) is held freely to move in the space between axis supporting structures (454*a*, 454*b*) and axis supporting structures (452*a*, 452*b*) by a foreside support axis (456), a rear support axis (457) and a foot rest support part (406*a*).

As the first embodiment and the third embodiment, when a foot rest (401) moves in a cross direction, in consideration of its small movement right and left, due to the strength of the foot of a healthy side being stronger than the strength of the foot of a disabled side, the movement width of about 10 cm right and left is set.

Therefore, it is important for a motivative exercise to have no ache and a corrective exercise is eased off the fixed direction moving.

However, a resistive exercise and a corrective exercise are also important, it is possible to do a resistive exercise and a corrective exercise in the cross and vertical direction due to carrying out a load to a rear support axis (457) by a manual operation, linear motor, a mechanical self-propelled movement or an electrical self-propelled movement by use of a motor of a rear support axis (457).

Also in the fourth embodiment, although the amount of movements was set up according to a patient's condition, the number of times, acceleration or speed is detected and used by using an accelerometer so that a movement is not possible when the set amount of movements is ended.

First of all, it detects with an accelerometer (450), the number of times is counted in increments of 1 when acceleration newly occurs and it sequentially counts the amount of movements by carrying out sequential calculations of the number of times.

In order to set up the number of times of movement, it sets up with a motion times setting switch (418).

It is a structure that is not able to release if a reset switch (419) is used after completion.

The number is sufficient to be able to set it up from 10 times to about 50 times.

You may increase the number of times for a resistive exercise.

In this case, even 10,000 times can be set up.

Furthermore, if the function of a control unit (429) with using a microcomputer, it is also possible to be set up for time usage.

In the case of control by using acceleration either acceleration or speed can be used as a measurement value, it is the same as that of the first embodiment in the case of speed.

In the case of using acceleration, the amount of movements with the fine displacement is prescribed by making 0 since 10 G grade into the measurement range.

Also in this case, it is set up with an acceleration setting switch (422) and the cycle is enabled again with the reset switch (419).

In this embodiment, a drive mechanism (440) and a hook (442) are used in order to stop an exercise When vertical movement is chosen with an exercise selection switch (423), the condition where a foot rest (401) carries out vertical movement is shown by FIG. 22 (*a*) and FIG. 22(*b*).

If the position of a rear support axis (457) moves to FIG. 22 (*b*) from FIG. 22 (*a*), a load device (406*b*), the upper end part of which expands and contracts by sliding to the long holes of axis supporting structures (452*a*, 452*b*), applies a load.

A load device (406*b*) is prolonged, as shown in FIG. 22 (*b*); it always has shrinkage pressure and makes motivative exercise possible by the return power of a load device (406*b*).

When detection data reaches the fixed number of times or the fixed acceleration and speed which were set up, a connection part material (406*d*) is released due to a cancellation command and is set up from a control unit (429) in an electromotive hook (442) and then a hook (442) operates.

When a connection part material (406*d*) is opened the return power of a connection part material (406*d*) disappears and it becomes the condition that a foot rest (401) fell to the minimum without returning upward.

Moreover, a foreside support axis (456) that is fixed with a motionlessness help device (455*c*) becomes obstructive and a cross direction movement cannot be performed.

Namely, it becomes the condition that a brake worked.

Thus, by releasing a connection part material (406*d*), a hook (442) has applied brakes to rocking and has the function of a brake.

In addition, it is also possible to adopt brake mechanisms other than a hook (442).

When a cross direction movement is chosen with an exercise selection switch (423), the condition where a foot rest (401) carries out a cross direction movement is shown by FIG. 23 (*c*).

A hook (442) is canceled and the lower end of a connection part material (406*d*) is free.

Therefore, a load device (406*b*), which is a shrunk structure, moves back and forth for the overall length of the long hole that was opened to an axis supporting structure (452*a*) with a cross direction exercise.

A cross direction movement is requested almost 40 cm in length and a long hole, which has been opened to an axis supporting structure (452*a*) is able to materialize the movement.

When detection data reaches the fixed number of times or the fixed acceleration and speed, which were set up at this time, the command that raises an up-down system (443) comes from a control unit (429) to a motor (445) of a drive mechanism (440).

When an up-down system (443) rises by a command, it becomes hard to move in a cross direction because an up-down system (443) becomes obstructive for the cross direction movement of a load device (406*b*).

In other words it assumed that a brake works.

Thus, an up-down system (443) has the function of a brake.

In addition, it is also possible to adopt brake mechanisms other than an up-down system (443).

Thus, the time of making a foot rest (401) rock in the vertical direction, a hook (442) engages a connection part material (406*d*) and the time of making a foot rest (401) move in the cross direction with reciprocating motion, a hook (442) releases a connection part material (406*d*).

Moreover, the time of making a foot rest (401) rock in the vertical direction and stop the reciprocating movement in the cross direction, an up-down system (443) has gone up and the time of making a foot rest (401) move in the cross direction with reciprocating motion and an up-down system (443) has descended.

A lower limb function training device of the fourth embodiment is constituted by this appearance.

Furthermore, in this specification, front and back and also right and left direction of a lower limb function training device are set up in the same direction as front and back and also right and left direction of the patient who uses a lower limb function training device.

As mentioned above, although the embodiments of this invention was explained in full detail, this invention can perform various changes within the limits of the gist of this invention and the claims, which is not limited to the above-mentioned embodiments.

The example of change of this invention is illustrated below.

(1) In the embodiments mentioned above, although the speed of a foot rest is set up by the average value for every fixed interval (for example, during the movement of a foot rest forward and every fixed time), it is also possible to compose a brake device which applies brakes if the highest speed for every fixed interval of order movement or rocking becomes below set value.

If the average value of the movement of reciprocating in the cross direction or the rocking of the foot rest requires more time to perform, it is good for setting up a brake device that brakes in the cross direction movement or the rocking movement of a foot rest, for example, it is also possible to operate a brake when a value of the acceleration becomes smaller than a regular interval set instead of a speed.

Furthermore, it is also possible to apply brakes at the rocking speed of a foot rest.

And a rocking speed for applying brakes is set up by the average value for every fixed interval (for example, in every fixed time and under a movement of a foot rest to the lower part).

(2) A moveable structure of foot rest (1) for a cross direction can be changed suitably.

For example, arrangement and the quantity of wheels can be changed suitably.

However, in order to stabilize a foot rest, it is desirable to arrange wheels to the front and rear, right and left of the lower part of a foot rest.

(3) An output from an external output unit is possible also by a communication cable or a memory medium.

(4) A load device, which adds a load in the cross direction movement of a foot rest (1), can be any structure other than motors (19, 29). For example, it is possible also with a device, which adds friction resistance to a wheel or a movable belt.

(5) A structure and a form of a speed sensor can be suitably changed, if the speed of a foot rest (1), especially if the speed of the front are detectable.

For example, it is also possible to detect a speed of a foot rest (1) indirectly.

Moreover, the number of times of a reciprocating motion of a foot rest can also be calculated by the number of times of change in the direction of speed, which has detected a speed sensor.

In this case, a speed sensor serves as the function of a number-of-times detection sensor.

(6) Warning devices such as a buzzer and a lamp are assembled and when making a brake device operate in case that the number of times and the speed of a reciprocating motion of a feet setter become a set value, it is also possible to operate this warning device.

(7) It is also possible to form drive equipment, such as a motor, which makes a foot rest rock.

(8) Although an accelerometer (450) has detected indirectly the acceleration in a cross direction of a foot rest (401) and the acceleration in the rocking direction by detecting the acceleration in a cross direction, since the detection accuracy of the acceleration of the rocking direction is not so good, it can also form separately the acceleration detection device which detects the acceleration of the rocking direction.

For example, it arranges between a foot rest support part (406*a*) and a rear support axis (457) or arranges to a foot rest (401).

Possibility On Industry Usage

This invention is effective when motivative exercise is done for both feet, in the case that there is a disability as a result of hemiparesis after apoplexy, a decline of muscular strength by the rupture of the Achilles' tendon and disabilities of the range of motion in the joint of a leg or knee originating in a bone fracture in one leg, which is the foot with a disability and another healthy foot without any disability, in the sitting position on a chair.

It is an effective training machine, which realizes movements of both a cross direction and vertical direction.

So as to perform a motivative exercise of a disabled lower extremity by a healthy lower extremity, heretofore lower extremities function training devices, which were divided into each training device that could only perform in a cross direction movement or in a vertical direction movement; two kinds of the devices could be summarized to one machine in order to make it positively usable in a. narrow house.

In this way, it is easy to treat and data is outputted outside, it becomes easy to perform a medical checkup or to change a training menu by remote control.

Moreover, in order to know a patient's condition conventionally, a physical therapist measured the angle of extremities with a contracture and has measured the patient's body situation.

Therefore, the physical therapist and a patient must be in the same place to perform needed measurement.

In this fourth embodiment, telemetry becomes possible because of the measurement of the angle of the lower extremities, which has a contracture becomes possible by the relation of feet and legs of four points contacting simultaneously.

At once to eliminate the ambiguity by viewing becomes available.

And a brake device brakes on a foot rest and can suspend an exercise in the case that a patient gets tired and the movement of a foot rest becomes slow; in the case of a brake device braking in a cross direction of a foot rest at the time of a reciprocating motion in a cross direction movement of a foot rest needs a longer time.

Consequently, too much movement of a patient can be prevented.

And a brake device brakes on a foot rest and can suspend an exercise in the case that a patient gets tired and the movement of a foot rest becomes slow; in the case of a brake device braking in a cross direction of a foot rest at the time of a reciprocating motion in a cross direction movement of a foot rest support axis needs a longer time.

Consequently, too much movement of a patient can be prevented.

And a foot rest is manually moved by a physical therapist, detection of the feet with contracture occurs by touching the four points of a foot rest and it is possible to automate detection of an angle of lower extremities with contracture namely the grade of contracture by outputting the angle.

Data for a research and a management of the momentum of a patient can be obtained easily, in the case that a lower limb function training device is outputting at least single detected data by a round-trip movement number sensing device and a movement speed detection device in the outside.

Also, in the case that a lower limb function training device uses a caster that can move over a surface of varying height and can certainly remain in any position, it can carry out training and exercise freely at home in a place where a patient wishes or in which a patient is present.

Also, in the case that a lower limb function training device can carry out training and exercise freely at home in a place where a patient wishes or in which a patient is present and can transmit data, data for research and management of the momentum of a patient can be obtained easily by telemetry.

Also, in the case that a lower limb function training device has a movement and operation device, such as, a plastic automobile toy-model kit and forms the structure of a doll such as a cat or a child etc., it can carry out training and exercise, which a patient wishes to perform freely at home, it can heighten daily life as a favorite article and a management of kinetic momentum and daily data of training can be obtained easily by telemetry.

What is clamed is:

1. A lower limb function training device for rehabilitation of the lower extremities of a user, comprising:

a single foot rest adapted to receive both feet of said user side by side, said single foot rest having an upper surface for placing both feet which are together thereon, a foot rest support structure, a foot rest drive mechanism; wherein said foot rest drive mechanism is arranged to reciprocate said foot rest with respect to said support structure in a longitudinal or transverse direction of the device and a round-trip movement sensing device which detects round-trip movements of the foot rest in the longitudinal or transverse direction.

2. A device according to claim 1, including at least one contact sensor on a surface of the foot rest wherein the at least one contact sensor is able to detect the soles of the feet contacted at four points of the foot rest simultaneously.

3. A device according to claim 2, including wherein said round-trip movement sensing device includes at least either one of a round-trip movement number sensing device that detects a number of reciprocating motions of the foot rest in the longitudinal and/or transverse directions, a round-trip movement number sensing device that detects a number of reciprocating motions of the foot rest in the longitudinal and/or transverse directions and a round-trip movement acceleration sensing device that detects an acceleration of reciprocating motions of the foot rest in the longitudinal and/or transverse directions.

4. A device according to claim 3, including wherein detected data of said round-trip movement number sensing device, said movement speed detection device and/or said round-trip movement acceleration sensing device is output to an external device.

5. A device according to claim 1, including wherein said footrest includes heel support means extending from the foot rest to restrict rearward longitudinal movement of the user's feet with respect to the foot rest, and feet retaining means for releasably retaining the user's feet to the foot rest.

6. A device according to claim 5, wherein the feet retaining means includes either one or two bands for retaining the feet to the foot rest.

7. A device according to claim 1, including wherein said round-trip movement sensing device includes at least either one of a round-trip movement number sensing device that detects a number of reciprocating motions of the foot rest in the longitudinal and/or transverse directions, a round-trip movement number sensing device that detects a number of reciprocating motions of the foot rest in the longitudinal and/or transverse directions or a round-trip movement acceleration sensing device that detects an acceleration of reciprocating motions of the foot rest in the longitudinal and/or transverse direction.

8. A device according to claim 7, including wherein detected data of said round-trip movement number sensing device, said movement speed detection device and/or said round-trip movement acceleration sensing device is output to an external device.

9. A device according to claim 1, including a foot joint data acquisition device which obtains data of a condition of the knee and/or ankle joints of a user.

10. A device according to claim 9, wherein the foot joint data acquisition device obtains data of a condition of the joints of the lower extremities when the at least one contact sensor detects the soles of the feet contacting at four points of the foot rest simultaneously.

11. A device according to claim 1, including a brake device, which brakes the reciprocating movement when the number of the reciprocating movements that said round-trip movement number sensing device, said movement speed detection device and/or said round-trip movement acceleration sensing device detects reaching a pre-determined value.

12. A device according to claim 11, wherein the brake device slows the reciprocating movement when a longer time is needed for the foot rest to reciprocate in a longitudinal direction.

13. A device according to claim 1, including a load device which applies a load to resist reciprocating of the foot rest by a user.

14. A device according to claim 1, wherein said foot rest drive mechanism includes one or more of an electric motor, hydraulic and/or pneumatic actuators.

15. A device according to claim 14, wherein the at least one load device is selected from one or more of an electric motor, and/or hydraulic or pneumatic means, or a combination thereof.

16. A lower limb function training device for rehabilitation of the lower extremities of a user, comprising:

a single foot rest adapted to receive both feet of said user side by side, said single foot rest having an upper surface for placing both feet which are together thereon, a foot rest support structure, a foot rest drive mechanism; wherein said foot rest drive mechanism is arranged to reciprocate said foot rest with respect to said support structure in a longitudinal or transverse direction of the device and at least one contact sensor on a surface of the foot rest wherein the at least one contact sensor is able to detect the soles of the feet contacted at four points of the foot rest simultaneously.

17. A device according to claim 16, including wherein said footrest includes heel support means extending from the foot rest to restrict rearward longitudinal movement of the user's feet with respect to the foot rest, and feet retaining means for releasably retaining the user's feet to the foot rest.

18. A device according to claim 17, wherein the feet retaining means includes either one or two bands for retaining the feet to the foot rest.

19. A device according to claim 16, including a foot joint data acquisition device which obtains data of a condition of the knee and/or ankle joints of a user.

20. A device according to claim 19, wherein the foot joint data acquisition device obtains data of a condition of the joints of the lower extremities when the at least one contact sensor detects the soles of the feet contacting at four points of the foot rest simultaneously.

21. A device according to claim 16, including a brake device, which brakes the reciprocating movement when the number of the reciprocating movements that said round-trip movement number sensing device, said movement speed detection device and/or said round-trip movement acceleration sensing device detects reaching a pre-determined value.

22. A device according to claim 21, wherein the brake device slows the reciprocating movement when a longer time is needed for the foot rest to reciprocate in a longitudinal direction.

23. A device according to claim 16, including a load device which applies a load to resist reciprocating of the foot rest by a user.

24. A device according to claim 16, wherein said foot rest drive mechanism includes one or more of an electric motor, hydraulic and/or pneumatic actuators.

25. A device according to claim 24, wherein the at least one load device is selected from one or more of an electric motor, and/or hydraulic or pneumatic means, or a combination thereof.

26. A lower limb function training device for rehabilitation of the lower extremities of a user, consisting of:

a single foot rest adapted to receive both feet of said user side by side, said single foot rest having an upper surface for placing both feet which are together thereon, a foot rest support structure;

a foot rest drive mechanism; wherein said foot rest drive mechanism is arranged to reciprocate said foot rest with respect to said support structure in a longitudinal or transverse direction of the device and a round-tip movement sensing device includes at least either one of a round-trip movement number sensing device that detects a number of reciprocating motions of the foot rest in the longitudinal and/or transverse directions, a round-trip movement number sensing device that detects a number of reciprocating motions of the foot rest in the longitudinal and/or transverse directions and a round-tip movement acceleration sensing device that detects an acceleration of reciprocating motions of the foot rest in the longitudinal and/or transverse directions.

* * * * *